US006254079B1

(12) United States Patent
Suzuki et al.

(10) Patent No.: US 6,254,079 B1
(45) Date of Patent: Jul. 3, 2001

(54) SHEET PROCESSING UNIT

(75) Inventors: Takahiro Suzuki, Tokyo-To; Hiroyuki Kamiyama; Junichi Inoue, both of Yokohama, all of (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/447,565

(22) Filed: Nov. 23, 1999

(30) Foreign Application Priority Data

Nov. 24, 1998 (JP) ..... 10-332358

(51) Int. Cl.[7] ..... B65H 5/00

(52) U.S. Cl. ..... 271/10.1; 271/98; 271/104; 271/105; 271/112; 271/121

(58) Field of Search ..... 271/98, 104, 105, 271/112, 121

(56) References Cited

U.S. PATENT DOCUMENTS 1,698,400 * 1/1929 Guest .
1,888,194 * 11/1932 Broadmeyer .
3,025,052 * 3/1962 Gutteling .
3,403,904 * 10/1968 Kim .
3,572,686 * 3/1971 Day .
5,090,676 * 2/1992 Matsuno et al. ..... 271/12
5,108,084 * 4/1992 Ishikawa et al. ..... 271/9.02
5,135,213 * 8/1992 Malachowski et al. ..... 271/104
5,181,706 * 1/1993 Yamamoto et al. ..... 271/104 X
5,499,806 * 3/1996 Bourg ..... 271/9.11
5,645,274 * 7/1997 Ubayashi et al. ..... 271/94

* cited by examiner

*Primary Examiner*—Robert P. Olszewski
*Assistant Examiner*—Richard Ridley
(74) *Attorney, Agent, or Firm*—Oblon, Spivak, McClelland, Maier & Neustadt, P.C.

(57) ABSTRACT

A taking part has a taking unit that comes in contact with the piled sheets to generate a taking force and to take the sheets one by one with the taking force. A movable lever is arranged in a side of the taking unit with respect to the piled sheets, and a driving unit gives a driving force in a linear or rotational direction to the movable lever. A force controller controls the driving force given to the movable lever by the driving unit. A detecting unit detects a position of the movable lever, and a sheet supplying unit supplies the piled sheets to the taking unit. A sheet supplying unit controller controls the sheets supplying unit on the basis of the position of the movable lever detected by the detecting unit. The sheets are pressed by the lever at a preparatory step, and then the sheets are lifted and pressed to the taking unit while canceling the driving force by the lever. The sheet and the taking unit are assured to become in good contact with each other to make the taking operation stable.

15 Claims, 23 Drawing Sheets

POSITIONING MODE

TAKING MODE

POSITIONING MODE

TAKING MODE

POSITIONING MODE

TAKING MODE

POSITIONING MODE

TAKING MODE

POSITIONING MODE

TAKING MODE

POSITIONING MODE

TAKING MODE

POSITIONING MODE

TAKING MODE

POSITIONING MODE

TAKING MODE

POSITIONING MODE

TAKING MODE

SHEET PROCESSING UNIT

FIELD OF THE INVENTION

This invention relates to a sheet processing unit, in particular, to a sheet processing unit that can take out sheets one by one from piled sheets, convey the taken sheets, carry out a predetermined process to the conveyed sheets, classify the processed sheets and collect the classified sheets respectively.

BACKGROUND OF THE INVENTION

A conventional sheet processing unit can take out sheets from piled sheets one by one and convey the taken sheets one by one. The taken sheets can be processed (tested) and classified into the sheets for recycling or the sheets for discharging.

The conventional sheet processing unit comprises: a taking part for taking the sheets, a conveying part for conveying the taken sheets, a testing part for testing the conveyed sheets, a classifying part for classifying the sheets on the basis of the result of the testing, and a collecting part for collecting the classified sheets respectively.

The conventional sheet processing unit operates as follows. Collected sheets are conveyed into the unit as piled sheets. The piled sheets consist of n (desired number) sheets. The taking part takes out the sheets one by one from the piled sheets at regular intervals in succession. Then, the conveying part conveys the taken sheet at a high speed by using a belt mechanism. The testing part tests whether each of the conveyed sheets has any damage respectively, that is, whether each of them should be recycled or discharged. Then, the classifying part classifies and guides the tested sheets into two ways respectively. The guided sheets are collected as sheets for recycling or as sheets for discharging respectively. Additional classifying parts can be arranged in the sheet processing unit.

The collected sheets as the sheets for discharging are then processed by a shredder or the like. The speed of the sheet processing is constant at several decade sheets per second. The conveying speed is constant at several meters per second. A typical conventional sheet processing unit is explained with reference to FIGS. 23 and 24.

FIG. 23 schematically shows the construction of the typical conventional sheet processing unit. FIG. 24 is an enlarged view of a portion including a taking part of the conventional sheet processing unit. The conventional sheet processing unit 100 comprises: sheets 101, a taking part 102 for taking the sheets, a conveying part 103 for conveying the taken sheets, a testing part 104 for testing the conveyed sheets, a classifying part 105 for classifying the sheets on the basis of the result of the testing, and a collecting part 106 for collecting the classified sheets respectively. These parts 102 to 106 are arranged in order of the reference numbers. The taking part 102 has a sheet supplying unit 110, a taking unit 111 and a double-taking preventing unit 113.

The sheets 101 are conveyed to the sheet supplying unit 110 by a conveying unit (not shown) as piled sheets. The piled sheets have n (desired number) sheets. The sheets 101 are taken one by one at regular intervals successively by the sheet supplying unit 110 and the taking unit 111. Then, the taken sheets are supplied to a conveying way 112. The double-taking preventing unit 113, which is arranged at a distance from the taking unit 111, prevents two or more sheets from being taken at one time. The testing unit part 104 is arranged above the sheets conveyed on the conveying way 112 that is formed backward (right in FIG. 18, downward of the sheet conveying direction) with respect to the taking unit 111. The testing unit 104 tests a surface state (damaged state, soiled state) of each of the sheets 101, which are conveyed one by one.

The collecting part 106 has a portion for collecting sheets that should be recycled and a portion for collecting sheets that should be discharged. The sheets are classified by the result of testing with the testing unit 104, and guided into the portion for collecting sheets that should be recycled and the portion for collecting sheets that should be discharged, respectively. The respective guiding of the classified sheets is carried out by a facing-type gate unit 115 arranged on the conveying way 112.

The collecting part 106 has also wheels with fins 117. The wheels with fins 117 are adapted to receive and stop the sheets that are conveyed at a high speed. Then, the stopped sheets 101 fall and pile up again. The wheel 117 is roller-like, and the fins of the wheel 117 form spiral grooves around the center of the wheels 117. The wheels with fins are driven by a stepping motor or the like. The sheets that should be recycled are conveyed out from the sheet processing unit as piled sheets which consist of desired number of sheets. The sheets that should be discharged are conveyed to the discharging process.

Photoelectric sensors 119 are arranged at desired positions on the conveying way 112 for detecting a passage of each of the sheets 101. For simplicity, only one sensor 119 is shown in drawings. The photoelectric sensors 119 are also used for detecting timings of taking the sheets 101, intervals thereof and a jammed state (sheet-staffed state). The sensors 119 are also used to confirm guiding state of the sheets 101 into the collecting part 106 and to calculate intervals of the guiding. In addition, one of the photoelectric sensors 119, which is disposed just behind the taking unit 111, is used to detect intervals of the sheets just after taken and/or skews of the sheets just after taken.

The taking part 102 of the sheet processing unit is explained in more detail as below, with reference to the FIG. 24.

The taking part 102 has a sheet supplying unit 110, a vacuum-absorption type of taking unit 111 and a double-taking preventing unit 113.

The vacuum-absorption type of taking unit 111 has a vacuum chamber 121 with an opening. The inside of the chamber 121 can be maintained at a pressure lower than the atmospheric pressure. A thin cylindrical rotor 122 is disposed around the chamber 121, and is adapted to rotate around the same. Some holes are provided with the rotor 122. A plain belt 123 supplies a driven force to the rotor 122. The plain belt 123 also serves as a member of the conveying way 112.

The opening of the vacuum chamber 121 is arranged at an opposite position to sheets piled on the sheet supplying unit 110. When the rotor 122 rotates and the holes of the rotor 122 come above the opening of the chamber 121, a vacuum absorption force appears. An absorption part herein means a surface formed by the holes at that time. In addition, an open-close controller such as an electromagnetic valve (not shown) is disposed in a tube or the like connecting the vacuum chamber 121 and a suction unit such as a vacuum pump (not shown). Thus, the pressure in the vacuum chamber 121 can be controlled.

The sheet supplying unit 110 has: a sheet stage 124 for supporting greater parts of the sheets 101, a linear motor 125 fixed to the sheet stage 124 for generating a desired force, a lever 126 moved relatively with respect to the sheet stage 124 by the linear motor 125, and a position sensor 127 fixed to the sheet stage 124 for detecting the position of the lever 126.

The position sensor 127 is for example a non-contact type of displacement meter. The sheet stage 124 is connected to an actuator for driving via a transmitting mechanism such as a ball-screw (not shown). The actuator for driving is controlled by a controlling unit (not shown) on the basis of the value of the position sensor 127.

As shown in FIG. 2, the double-taking preventing unit 113 has a chamber whose inside can be maintained at a pressure lower than the atmospheric pressure. The unit 113 also has a surface facing to the rotor 122 and having such a curvature that the surface is along the rotor 122 at a distance. The surface has some holes to the inside of the chamber. Then, the sheet passing between the rotor 122 and the double-taking preventing unit 113 can be absorbed and stopped.

The operation of taking of the sheets is explained as below.

A desired electric current is given to the linear motor 125 to generate a desired driving force which moves the lever 126 upward. When the sheet stage 124 moves toward the taking unit 111, the sheet of the top of the piled sheets becomes in contact with the absorption part of the rotor 122, and is pressed to the absorption part thereof. A downward force to the lever 126 is generated by the press. If the downward force becomes not less than the driving force, the lever 126 starts to move downward. Then, the position sensor 127 measures the position of the lever 126 i.e. the displacement thereof relative to the sheet stage 124. When the positioning of the sheet stage 124 is carried out in such a manner that the measured value is a predetermined value or within a predetermined range, the sheet 101 and the rotor 122 are pressed to each other with a pressure of a predetermined value or in a predetermined range.

Thus, the controlling unit (not shown) positions the sheet stage 124 in such a manner that the measured value of the position of the lever 126 is the predetermined value or within the predetermined range.

When the measured value becomes the value or within the predetermined range, the open-close unit such as a electromagnetic valve (not shown), which has been closed till then, is opened to enable the sheets to be taken. At that time, airflow can be jetted from a nozzle or the like to a not-pressed portion (right portion in FIG. 18) of the sheets to promote to separate the sheets. The double-taking preventing unit 113 prevents a not-targeted sheet from being taken when a targeted sheet is taken.

As described above, the sheet processing unit employs a press-type sheet supplying, in which the sheet 101 are pressed to the taking rotor 122. Thus, the sheet 101 and the absorption part of the taking rotor 122 are assured to become in good contact with each other. Thus, the absorption force of the taking rotor 122 is efficiently transmitted to the sheet 101 to make the taking operation stable. In the case, a contacting state between the absorption part of the rotor 122 and the sheet 101, and a force transmitting state are detected as the pressing force while the sheet 101 is taken.

Recently, improvement of the performance of the sheet processing unit is requested. Especially, further improvement of the processing speed and the taking accuracy is requested.

However, the above conventional sheet processing unit has a problem that the taking accuracy becomes worse when the large number of the sheets are set on the sheet stage. The conventional sheet processing unit also has a problem that the taking accuracy becomes worse depending on the kind or the state of the sheets. In addition, the conventional sheet processing unit has such a complex sheet supplying unit that the sufficient intervals are necessary for the taken sheets. That is, the conventional sheet processing unit has a difficulty for the successive taking.

SUMMARY OF THE INVENTION

The object of this invention is to solve the above problems, that is, to provide a sheet processing sheet that can take sheets one by one at a high speed and with high accuracy, however large the number of the set sheets is, and whatever the kind or the state of the sheets is.

In order to achieve the object, a sheet processing unit according to the invention comprises: a taking part for taking sheets one by one from piled sheets, a conveying part for conveying the taken sheets, and a processing part for carrying out a process to the conveyed sheets, the said taking part having: a taking unit for coming in contact with the piled sheets to generate a taking force and to take the sheets one by one with the taking force, a movable lever arranged in a side of the taking unit with respect to the piled sheets, a driving unit for giving a driving force in a linear or rotational direction to the movable lever, a force controller for controlling the driving force given to the movable lever by the driving unit, a detecting unit for detecting a position of the movable lever, a sheet supplying unit for supplying the piled sheets to the taking unit, and a sheet supplying unit controller for controlling the sheet supplying unit on the basis of the position of the movable lever detected by the detecting unit.

In the case, preferably, the taking unit has a rotatable roller, the rotatable roller has an operating part for generating the taking force and a concave portion having a smaller diameter than the operating part, and the movable lever is movable into the concave portion.

Furthermore, the rotatable roller is preferably driven by a belt, and the belt has a function for conveying the sheets and is arranged in such a manner that the belt is away from the sheets when the position of the movable lever is detected.

Preferably, the operating part has a curvature, the movable lever has a portion capable of coming in contact with the sheets, and the portion having a curvature the same as the curvature of the operating part.

Preferably, the taking unit takes the sheets by repeating a cycle which includes: a positioning mode wherein the operating part is away from the sheets and the movable lever presses and positions the sheets, and a taking mode wherein the operating part comes in contact with the sheets and the movable lever gives no driving force to the sheets.

In the case, preferably, the taking unit has a function to automatically adjust a timing of the cycle when the sheets are not positioned in a predetermined range in the positioning mode.

Preferably, a second detecting unit is provided for detecting at least one of a velocity and an acceleration of the movable lever. In the case, the sheet supplying unit may control the sheet supplying unit on the basis of at least one of the velocity and the acceleration of the movable lever detected by the second detecting unit.

Preferably, the force controller may control the driving force based on at least one of a thickness of the piled sheets, a number of the sheets and a frictional coefficient of the sheets.

Preferably, the sheet supplying unit controller may control the sheet supplying unit based on at least one of a taking pitch of the sheets, a state of skews of the sheets, a state of slides of the sheets, a state of slide values of the sheets and a state of double-takings of the sheets. Similarly, the force controller may control the driving force based on at least one of the taking pitch of the sheets, the state of the skews of the sheets, the state of the slides of the sheets, the state of the slide values of the sheets and the state of the double-takings of the sheets.

Preferably, a measuring unit is provided for measuring at least one of a position, a velocity and an acceleration of the sheet supplying unit. In the case, the sheet supplying unit controller may control the sheet supplying unit based on at least one of the position, the velocity and the acceleration of the sheet supplying unit measured by the measuring unit. Similarly, the force controller may control the driving force by the driving unit based on at least one of the position, the velocity and the acceleration of the sheet supplying unit measured by the measuring unit. In the case, furthermore, an analogizing unit is preferably provided for identifying a system or a state of the piled sheets with an information of the number of the sheets piled on the sheet stage. In the case, the system or the state of the piled sheets can be identified by the analogizing unit to be used by the sheet supplying unit and the force controller.

In addition, preferably, the driving unit has: a linear motor having a coil, a magnet capable of influencing the coil, and a moving mechanism capable of moving the magnet at a high speed.

Preferably, a stopper is provided for regulating a movable range of the movable lever in the concave portion of the rotatable roller of the taking unit. In the case, a stopper remover may be provided for removing the stopper.

Preferably, a damper is provided for reducing a disturbance of the sheets.

Preferably, the movable lever is movable in a direction perpendicular to each of the piled sheets.

Another sheet processing unit according to the invention comprises: a taking part for taking sheets one by one from piled sheets, a conveying part for conveying the taken sheets, and a processing part for carrying out a process to the conveyed sheets, the said taking part having: a taking unit for coming in contact with the piled sheets to generate a taking force and to take the sheets one by one with the taking force, a movable lever arranged in a side of the taking unit with respect to the piled sheets, a positioning unit for positioning the movable lever at a predetermined position, a pressure sensor provided on a surface of the movable lever facing to the piled sheets for detecting a pressure to the piled sheets, a sheet supplying unit for supplying the piled sheets to the taking unit, and a sheet supplying unit controller for controlling the sheet supplying unit on the basis of the pressure detected by the pressure sensor.

In the case, preferably, the taking unit has a rotatable roller, the rotatable roller has an operating part for generating the taking force and a concave portion having a smaller diameter than the operating part, and the movable lever is movable into the concave portion.

Furthermore, preferably, the operating part has a curvature, the movable lever has a portion capable of coming in contact with the sheets, and the portion having a curvature the same as the curvature of the operating part.

Another sheet processing unit according to the invention comprises: a taking part for taking sheets one by one from piled sheets, a conveying part for conveying the taken sheets, and a processing part for carrying out a process to the conveyed sheets, the said taking part having: a taking unit for generating an absorption force to come in contact with the piled sheets, to generate a taking force and to take the sheets one by one with the taking force, a sheet supplying unit for supplying the piled sheets to the taking unit, and a movable lever provided on the sheet supplying unit for supporting a front end portion of the piled sheets with respect to a conveying direction, a driving unit for giving a driving force in a linear or rotational direction to the movable lever, a force controller for controlling the driving force given to the movable lever by the driving unit, a detecting unit for detecting a position of the movable lever, a sheet supplying unit controller for controlling the sheet supplying unit on the basis of the position of the movable lever detected by the detecting unit, and a positioning unit for positioning the movable lever at a predetermined position, the positioning unit positioning the movable lever at a position away from the taking unit by a predetermined distance in cooperation with the taking unit when the taking unit generates the absorption force toward the piled sheets.

In the case, preferably, the taking unit has a rotatable roller, and the rotatable roller has an operating part for generating the taking force.

Another sheet processing unit according to the invention comprises: a taking part for taking sheets one by one from piled sheets, a conveying part for conveying the taken sheets, and a processing part for carrying out a process to the conveyed sheets, the said taking part having: a taking unit for generating an absorption force to come in contact with the piled sheets, to generate a taking force and to take the sheets one by one with the taking force, a sheet supplying unit for supplying the piled sheets to the taking unit, and a pressure sensor provided on a portion of the sheet supplying unit for detecting a pressure from the piled sheets, the portion supporting a front end portion of the piled sheets with respect to a conveying direction, and a sheet supplying unit controller for controlling the sheet supplying unit on the basis of the pressure detected by the pressure sensor, the sheet supplying unit controller positioning the sheet supplying unit at a position wherein the sheets supplied by the sheet supplying unit are away from the taking unit by a predetermined distance in cooperation with the taking unit when the taking unit generates the absorption force toward the piled sheets.

In the case, preferably, the taking unit has a rotatable roller, and the rotatable roller has an operating part for generating the taking force.

Another sheet processing unit according to the invention comprises: a taking part for taking sheets one by one from piled sheets, a conveying part for conveying the taken sheets, and a processing part for carrying out a process to the conveyed sheets, the said taking part having: a taking unit having a convex portion for pressing the sheets to adjust attitudes of the sheets, and a concave portion for generating an absorption force to come in contact with the sheets, to generate a taking force and to take the sheets one by one with the taking force, said convex portion and said concave portion repeatedly face to the piled sheets by turns, a sheet supplying unit for supplying the piled sheets to the taking unit, a movable lever provided on the sheet supplying unit for supporting a front end portion of the piled sheets with respect to a conveying direction, a driving unit for giving a driving force in a linear or rotational direction to the movable lever, a force controller for controlling the driving force given to the movable lever by the driving unit, a detecting unit for detecting a position of the movable lever, a sheet supplying unit controller for controlling the sheet supplying unit on the basis of the position of the movable lever detected by the detecting unit, and a positioning unit for positioning the movable lever at a predetermined position.

In the case, preferably, the taking unit has a rotatable roller, and the rotatable roller has: a portion having a larger diameter as the convex portion, and a portion having a smaller diameter as the concave portion.

Alternatively, preferably, the taking unit has a moving belt, and the moving belt has a protrusion as the convex portion.

Another sheet processing unit according to the invention comprises: a taking part for taking sheets one by one from piled sheets, a conveying part for conveying the taken sheets, and a processing part for carrying out a process to the conveyed sheets, the said taking part having: a taking unit having a convex portion for pressing the sheets to adjust attitudes of the sheets, and a concave portion for generating an absorption force to come in contact with the sheets, to generate a taking force and to take the sheets one by one with the taking force, said convex portion and said concave portion repeatedly face to the piled sheets by turns, a sheet supplying unit for supplying the piled sheets to the taking unit, a pressure sensor provided on a portion of the sheet supplying unit for detecting a pressure from the piled sheets, the portion supporting a front end portion of the piled sheets with respect to a conveying direction, and a sheet supplying unit controller for controlling the sheet supplying unit on the basis of the pressure detected by the pressure sensor.

In the case, preferably, the taking unit has a rotatable roller, and the rotatable roller has: a portion having a larger diameter as the convex portion, and a portion having a smaller diameter as the concave portion.

Alternatively, preferably, the taking unit has a moving belt, and the moving belt has a protrusion as the convex portion.

In addition, a gas spraying unit is preferably provided for spraying and introducing a gas between the sheets to promote to separate the sheets.

BEST MODE FOR CARRYING OUT THE INVENTION

Figure 1:
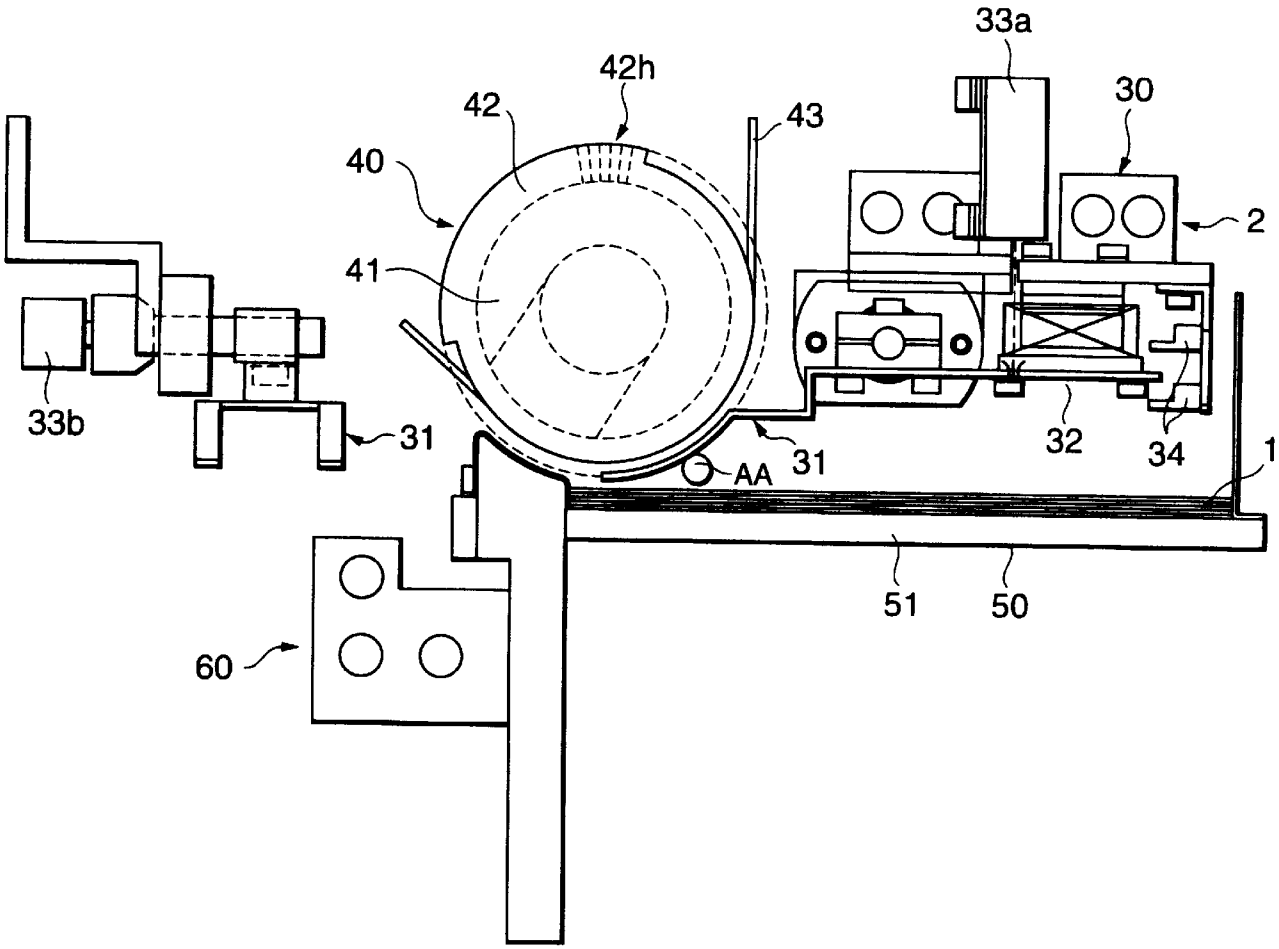
FIG. 1 is an enlarged view of a portion including a taking part of an embodiment of the sheet processing unit according to the invention.

Embodiments of the invention will now be described in more detail with reference to drawings.

Sheets herein include media made of paper or resin, such as securities, postal matters, magnetic cards or the like. An interval or an interval of taken sheets herein includes both a pitch between a point of a taken sheet and a point of a successively taken sheet and a gap between a tail of the taken sheet and the point of the successively taken sheet.

A skew herein means an inclination of the sheet in a direction of taking. A slide herein means a shift of the sheet in a direction perpendicular to the direction of taking. A slide value herein means a shift from a normal taking timing. A double-taking herein means to take two or more sheets at a normal taking timing.

First Embodiment

A taking part 2 has a detecting unit 30, a taking unit 40, a sheet supplying unit 50 and a double-taking preventing unit 60.

Figure 2:
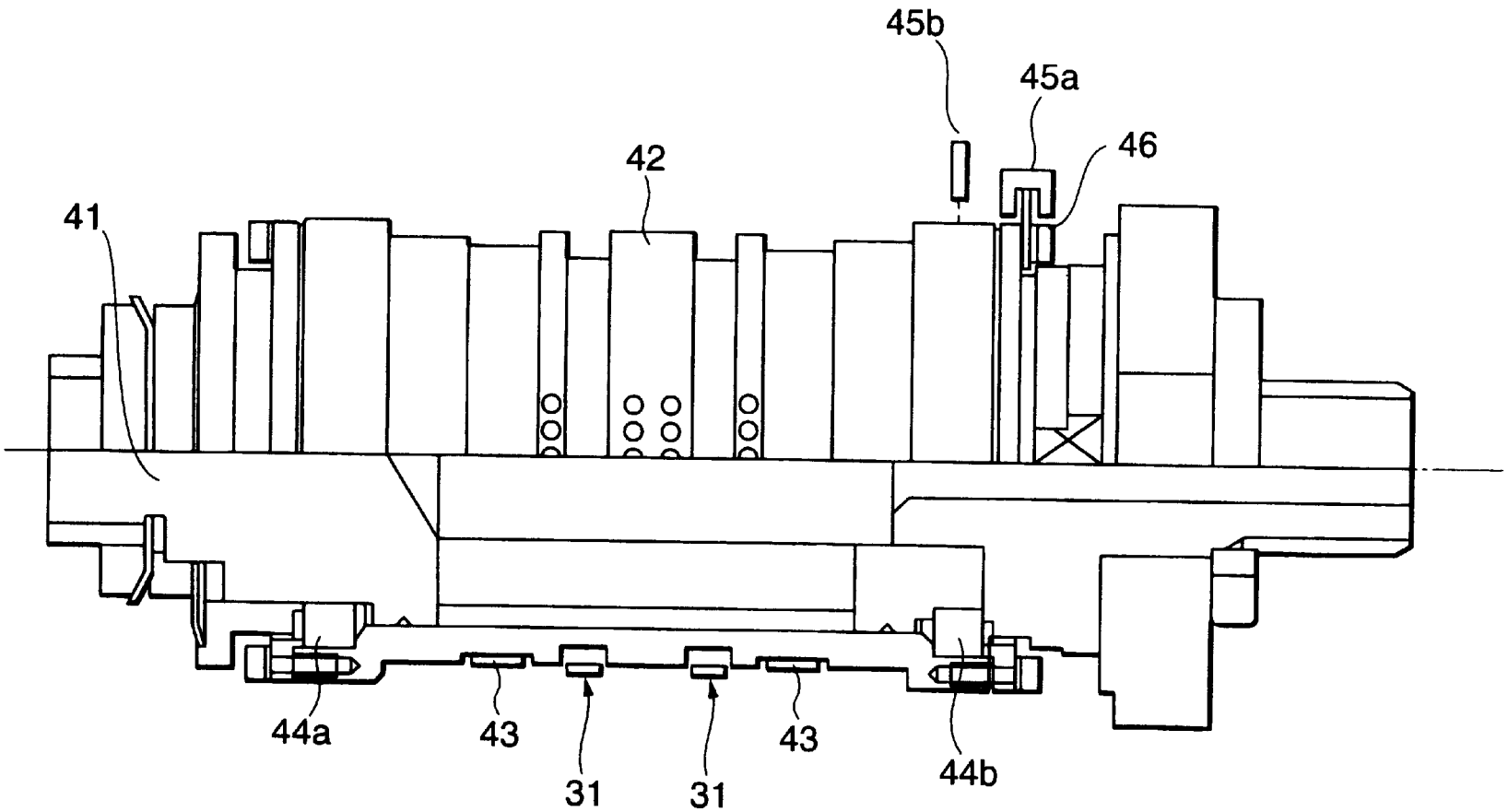
FIG. 2 is a front view of the taking part of the embodiment of the sheet processing unit according to the invention.

The detecting unit 30 has: a rotating lever 31 (see FIG. 2) movable into a recess of a rotor 42, a linear motor 32 for giving a desired torque to the rotating lever 31, a position sensor 33*a* for measuring a displacement of the rotating lever 31 or a rotating sensor 33*b* for measuring a rotating angle of the rotating lever 31, a stopper 34 for controlling movable range of the rotating lever 31, a driver for linear motor (not shown), an acceleration sensor (not shown) mounted on the rotating lever 31 and differential and/or integrate circuits for the sensors. The positioning sensor 33*a* may be a non-contact type of light sensor. The rotating sensor 33*b* may be a rotating type of light sensor. Thus, the rotating lever 31 can generate a desired force. In addition, the position, the velocity and the acceleration of the rotating lever 31 can be detected as described hereinafter with reference to FIG. 4.

The double-taking preventing unit 60 is adapted to prevent two or more sheets 1 from being taken from the sheet supplying unit 50. An air nozzle (gas spraying unit) is arranged at a position designated by AA in FIG. 1. Airflow from the nozzle flows between sheets 1 so that the double-taking is more efficiently prevented.

The air nozzle is connected to a blower or the like via an electromagnetic valve or the like in order to flow out a desired amount of gas such as air, at a desired timing. The taking unit 40 has a vacuum chamber 41 with an opening. The inside of the chamber 41 can be maintained at a pressure lower than the atmospheric pressure. A thin cylindrical rotor 42 is disposed around the chamber 41, and is adapted to rotate around the same. Some holes are provided with the rotor 42. A plain belt 43 can supply a driven force to the rotor 42. The plain belt 43 also serves as a member of the conveying system (not shown).

The opening of the vacuum chamber 41 is arranged at an opposite position to sheets 1 piled on the sheet supplying unit 50. When the rotor 42 rotates and the holes of the rotor 42 come above the opening of the chamber 41, a vacuum absorption force appears. An absorption part herein means a surface formed by the holes at that time. In addition, an open-close controller such as an electromagnetic valve (not shown) is disposed in a tube or the like connecting the vacuum chamber 41 and a suction unit such as a vacuum pump (not shown). The rotor 42 has a convex part having the holes for carrying out the taking of the sheets, and a concave part having no holes.

The rotor 42 is rotatably connected to the vacuum chamber 41 via bearings 44*a* and 44*b*. The rotating position and the velocity thereof are detected by an interrupting plate 46 mounted at the rotor 42 and a U-shaped penetration-type of sensor 45*a*. They may be also detected by a reflection-type of sensor 45*b*. In the latter case, different tapes having different reflectances may be mounted on the surface of the rotor 42 to which a light is radiated from the sensor 45*b*.

The concave part of the rotor 42 includes a groove for arranging the rotating lever 31 therein, and a groove for engaging the plain belt 43. The depth of the latter groove is so great that the plain belt 43 engaged therewith is still deeper than the surface of the convex part. Thus, the plain belt is prevented from contacting with the sheets.

Figure 3:
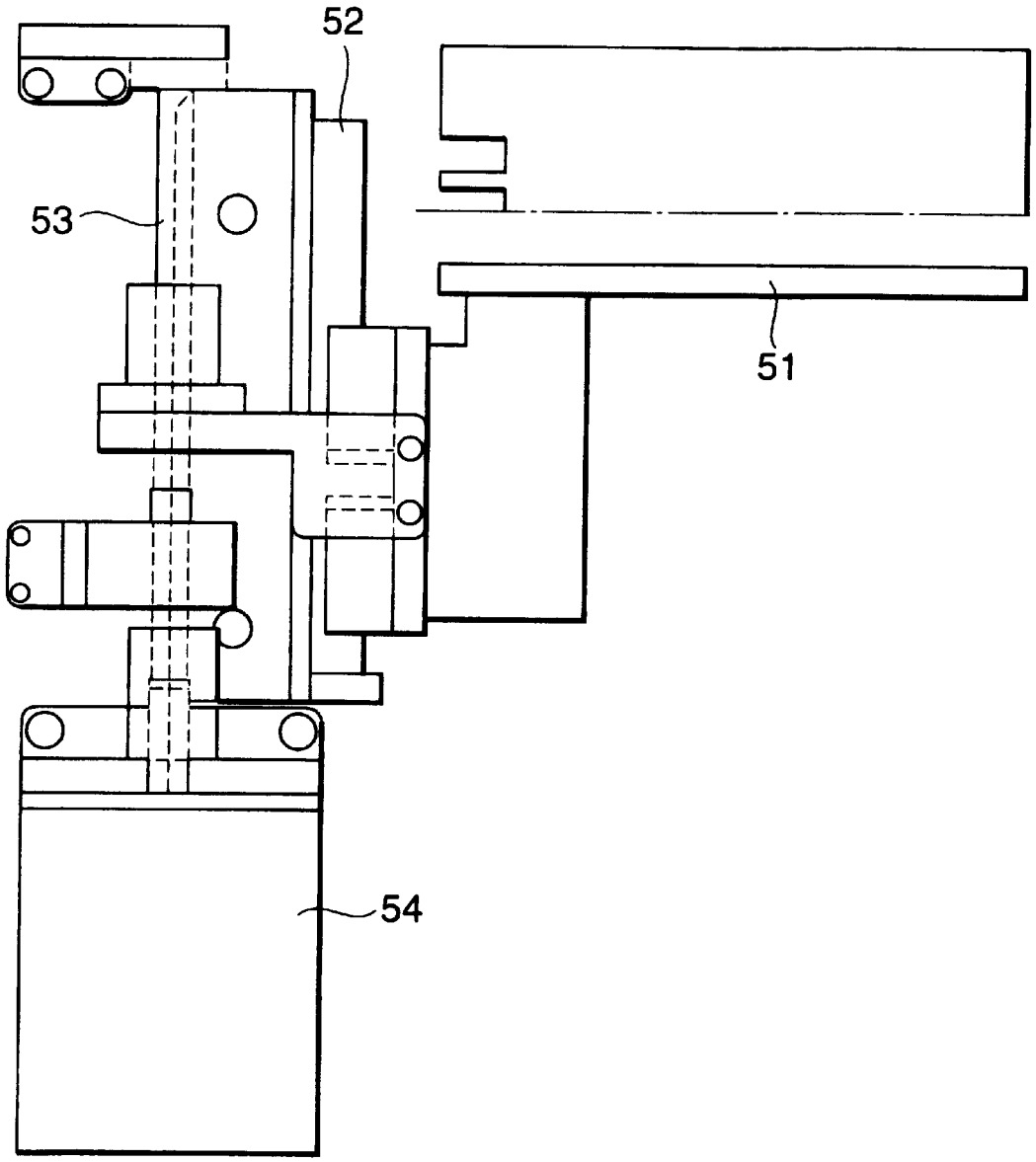
FIG. 3 is a side view of the sheet supplying unit of the embodiment of the sheet processing unit according to the invention.

As shown in FIG. 3, the sheet supplying unit 50 has a sheet stage 51 for placing piled sheets 1. The sheet stage 51 is connected to a motor 54 via a mechanism consisting of a linear slider 52 and a ball-screw 53. Thus, the sheet stage can be moved toward the taking unit 40 (upward in FIG. 3).

Figure 4:
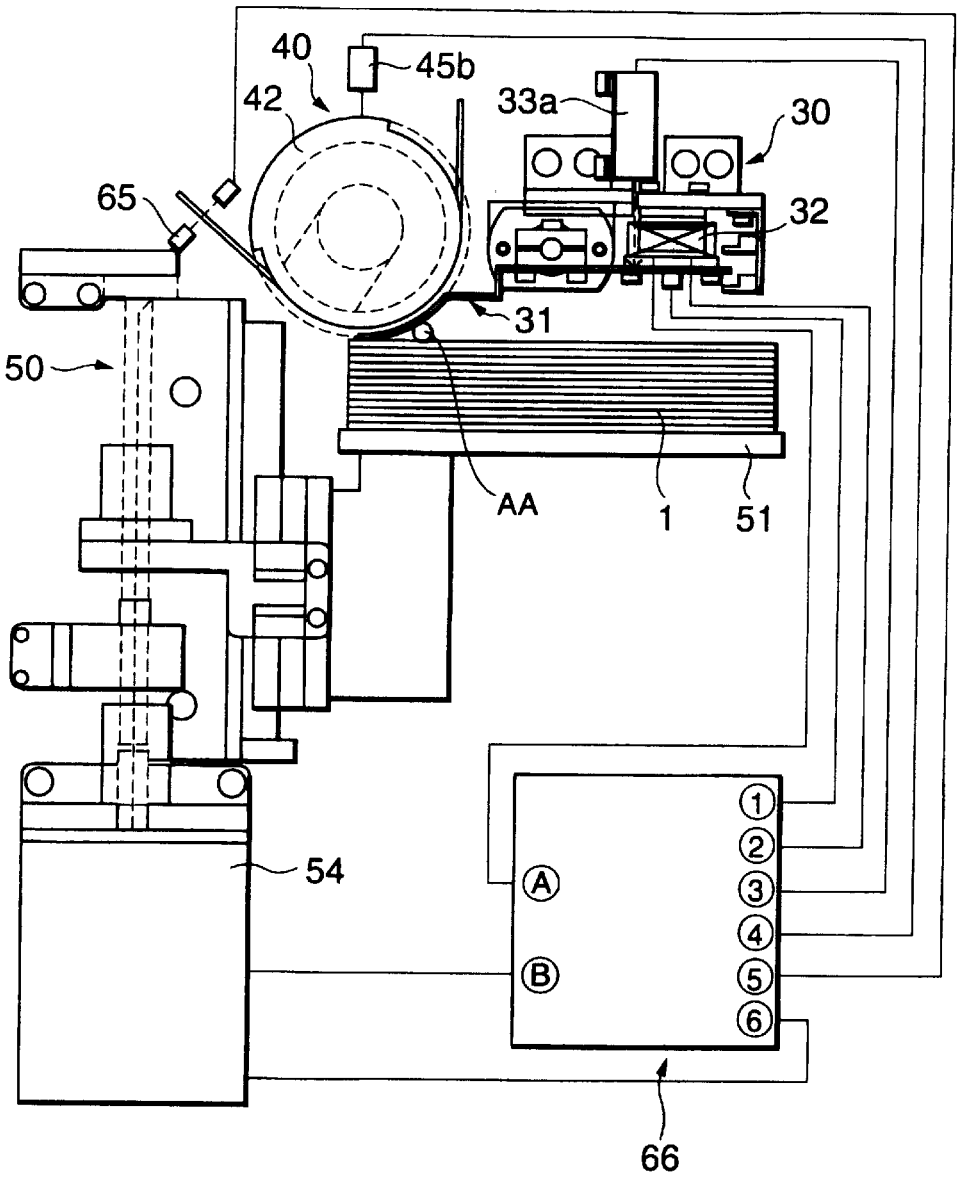
FIG. 4 is an explanatory view of a taking control in the embodiment of the sheet processing unit according to the invention.

A control of the taking operation of the sheets 1 is explained as below with reference to FIG. 4. A controller 66 can output a signal (B) for the motor 54 (a stepping motor or a servo motor) and a signal (A) for the linear motor 32. The controller 66 can be inputted a signal (1) from the acceleration sensor mounted on the rotating lever 31, an actual signal (2) of the linear motor 32 (the signal (2) is different from a requested value (A) because reverse power is generated by the moving of the rotating lever 31), a signal (3) from the positioning sensor 33*a* of the rotating lever 31, a signal (4) from the rotor rotating timing sensor 45*b*, signals (5) from a photoelectric sensor 65 for detecting pitches, skews and shift values of the taken sheets 1 and from a double-taking detecting sensor, signals (6) of a position, a velocity and an acceleration of the motor 54 (the signals (6) from encoders (not shown) if the motor is a stepping motor). The above signals may be electric current values.

The controller 66 has differential and/or integral circuits to convert the signals of the position, the velocity or the like into desired electric signals. A time can be measured by using the signals (4) and (5) as triggers. The measured time can be used in various controls. The controller 66 can output a control signal (not shown) for the electromagnetic valve which can open or close the tube to the air nozzle disposed at AA for flowing out air toward the sheets 1. Signals from light sensors and line sensors disposed near the sheet stage 51 may be inputted into the controller 66. Thus, the sheet stage 51 can be moved at a high speed while the sheets 1 are away from the detecting unit or the taking unit.

Examples of suitable adjustments for various states are explained as below.

(1) Improvement of the moving characteristic of the rotating lever:

By using the signal (4) of the rotating position of the rotor 42, the signal (1) of the moving of the rotating lever 31, the signal (6) of the moving of the motor, signals converted therefrom or the like, it can be detected that the rotating lever 31 cannot detect the upper surface of the piled sheets 1 for example because the lever 31 is in the air above the sheets 1 in no relation to the sheet supplying operation. In the case, the output (A) of the linear motor 32 is immediately changed so that the lever 31 detects and touches on the upper surface of the sheets 1.

(2) In advance, count the piled sheets adjustments for the state of the piled sheets:

Calculation of the number of the taken sheets can be carried out by using the signals (5) about the state of the taken sheet 1 detected by the sensor 65. By using the signals (1) and (3) of the moving of the rotating lever 31, the signal (6) of the moving of the motor, signals converted therefrom or the like, the number of the sheets 1 placed on the sheet stage 51, the thickness of the sheet and the responsibility of the taking unit can be measured. Regarding the responsibility, various information data can be obtained by using a stepwise feed of the sheet stage 51 or by sweeping frequencies of a periodic feed thereof. In accordance with the data, the controller 66 can choose a suitable one from predetermined combinations of parameters including a sheet supplying velocity, values for positioning mode, a pressing force, a position of the lever or the like.

(3) Adjustments for the taking state:

By using the signals (5) about the taken sheet 1 detected by the sensor 65, the signal (4) of the rotating position of the rotor 42 and the signal of double-taking detected by a sensor (not shown), the taking state of the taking unit such as pitches, slides (shifting values from a normal timing), skews, double-takings, or the like can be measured. If the taking state is not satisfactory, the controller 66 can change the combination of the parameters so that the taking state is satisfactory.

Figure 5:
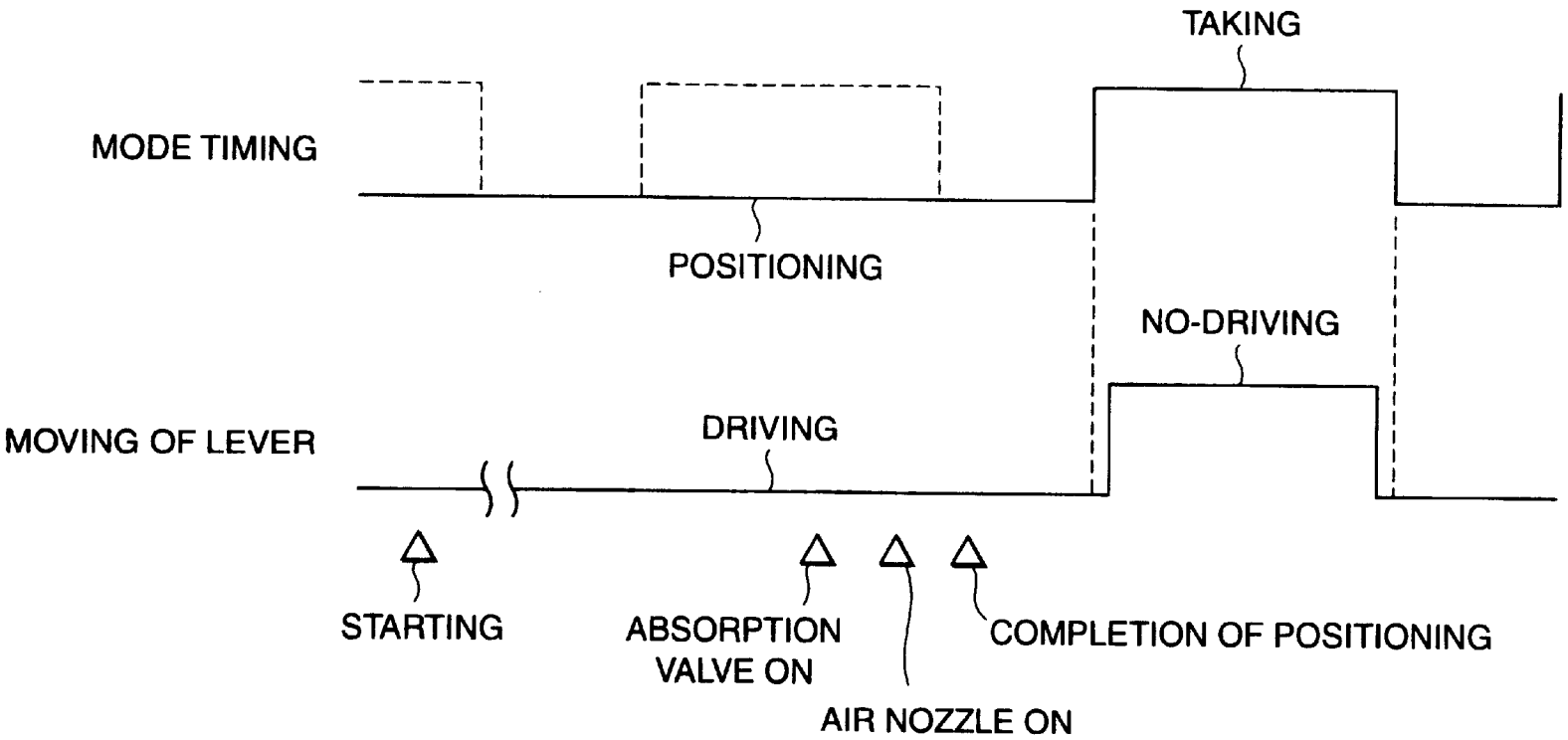
FIGS. 5, 6*a* and 6*b* are explanatory views of taking timings of the taking control in the embodiment of the sheet processing unit according to the invention.

A method for controlling the linear motor 32 in a taking operation of the sheet 1 is explained with reference to the FIG. 5.

The sheet stage 51 on which the sheets 1 are placed is moved in a predetermined direction to start supplying sheets. The lever 31, which is given a driving force by the linear motor 32, is pressed back by the sheets 1. Then, the electromagnetic valve for the nozzle and the electromagnetic valve for the chamber 41 are opened by the controller 66 when it is confirmed that the lever 31 is moved to predetermined positions respectively. After the initial positioning of the lever 31, the controller 66 detects a rotating timing of rotor 42. When the convex part of the rotor 42 faces to the piled sheets 1 (taking mode), the signal for giving the driving force is cancelled. That is, the linear motor 32 is controlled so that the lever 31 does not press the sheets 1. The signal for giving the driving force remains cancelled during the taking mode.

The moving of the lever 31 and the signal to the linear motor 32 are explained as below with reference to FIGS. 6*a* and 6*b*.

Figure 6A:
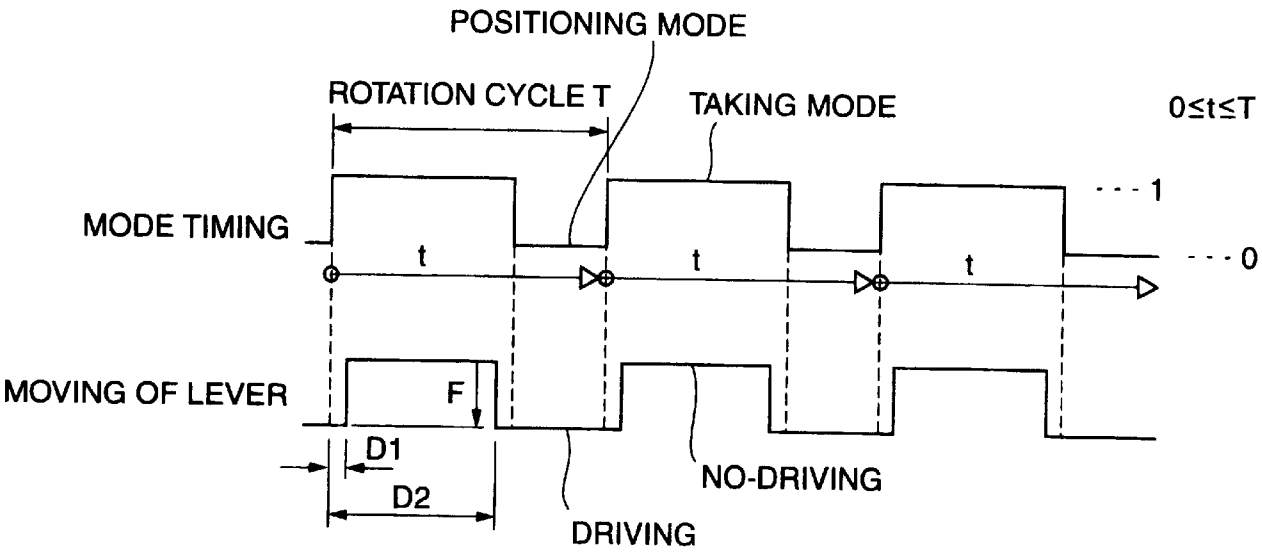
Figure 6B:
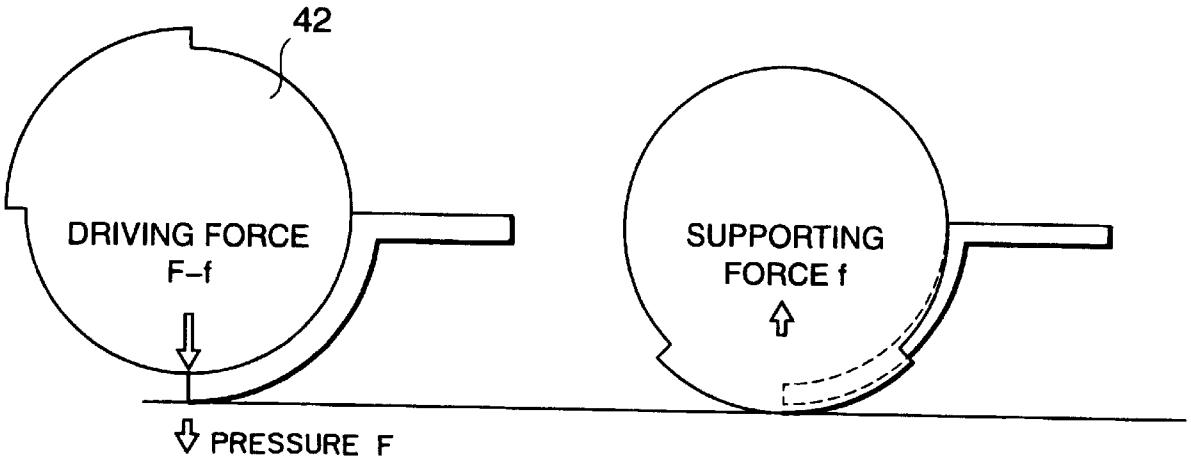

FIG. 6*a* shows rotational cycles T of the rotor 42 as rectangular waves. In FIG. 6*a*, 1 means a period that a sheet 1 taken with an ideal timing remains contacted with the rotor 42, and 0 means the other period. The period shown as 1 is called "taking mode". The period shown as 0 is called "positioning mode". The whole wave including the rectangular waves is called "mode timing." In FIG. 6*b*, f means a force for supporting a self-weight of the lever 31, and F+f means a driven force given to the lever 31. The lever 31 is supported by the force f (the sheets 1 are pressed by no force) from a delayed time D1 till a delayed time D2. The delayed time D2 may be longer than the tail time of taking mode. During the other term, the driving force F−f, whose direction is opposite to the above force f, is given to the lever 31 so that the sheets 1 are pressed by the force F.

More detailed modes can be set by measuring the time t as shown in FIG. 6*a*, besides the taking mode and the positioning mode. In addition, an amplifier for the linear motor can be changed to increase or decrease the driving force. The sheets 1 may be pressed at an emergency in spite of the rotational timing of the rotor 42.

Figure 7:
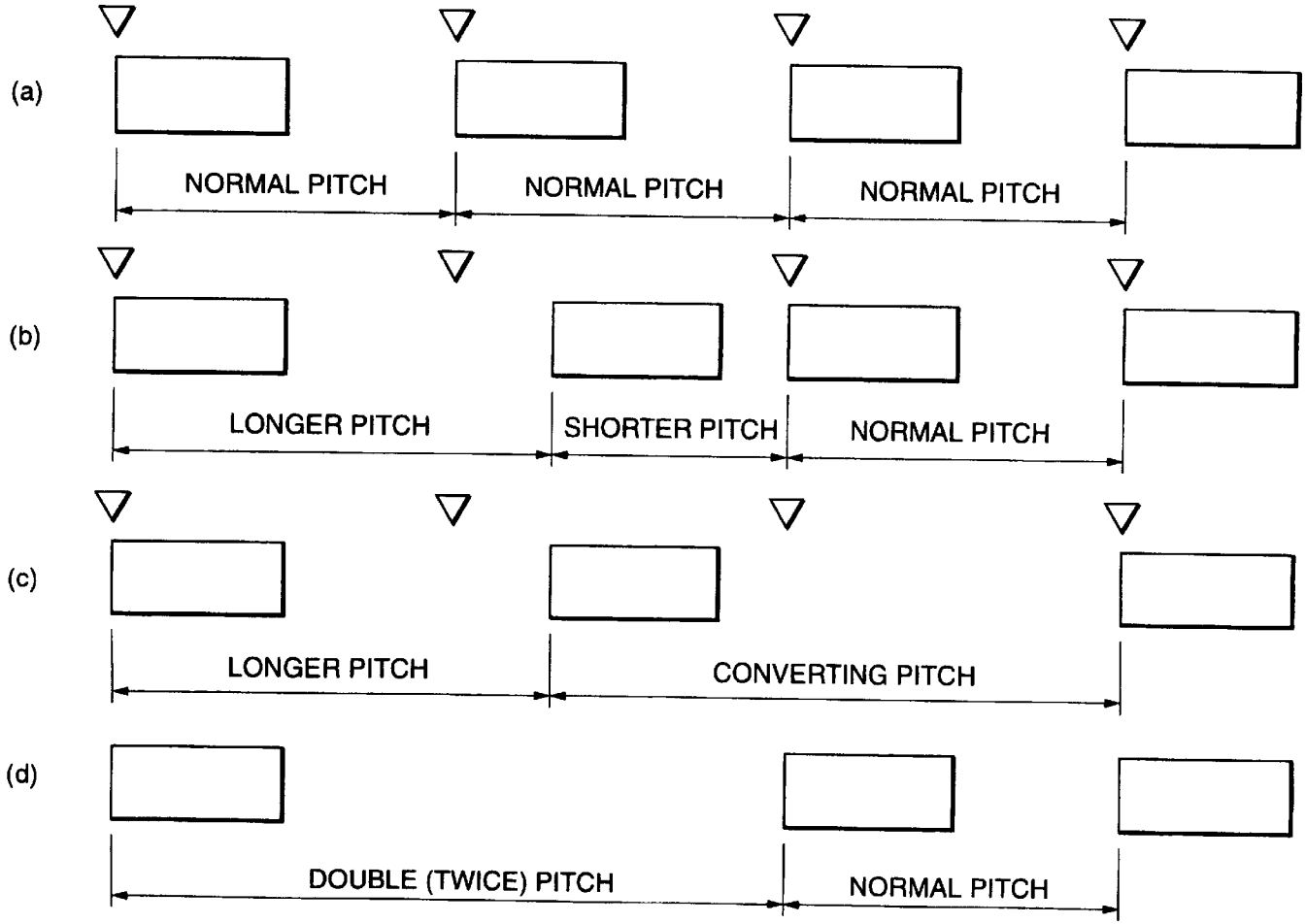
FIGS. 7*a* to 7*d* are explanatory views of a pitch converting mode of the taking control in the embodiment of the sheet processing unit according to the invention.

Pitch converting is explained as below with reference to the FIGS. 7*a* to 7*d*. As shown in FIG. 7*a*, the pitch is normal when the sheets 1 are taken by a normal cycle. As shown in FIG. 7*b*, when the sheet 1 is not taken by a normal cycle because of any factor, a longer pitch and a following shorter pitch may appear. This may disturb the following process. In order to avoid the disturbance, as shown in FIG. 7*c*, one taking operation may be skipped over. This controlling method is called "pitch converting". Alternatively, as shown in FIG. 7*d*, the sheet may be not taken by an abnormal cycle, but by a twice normal cycle.

Figure 8:
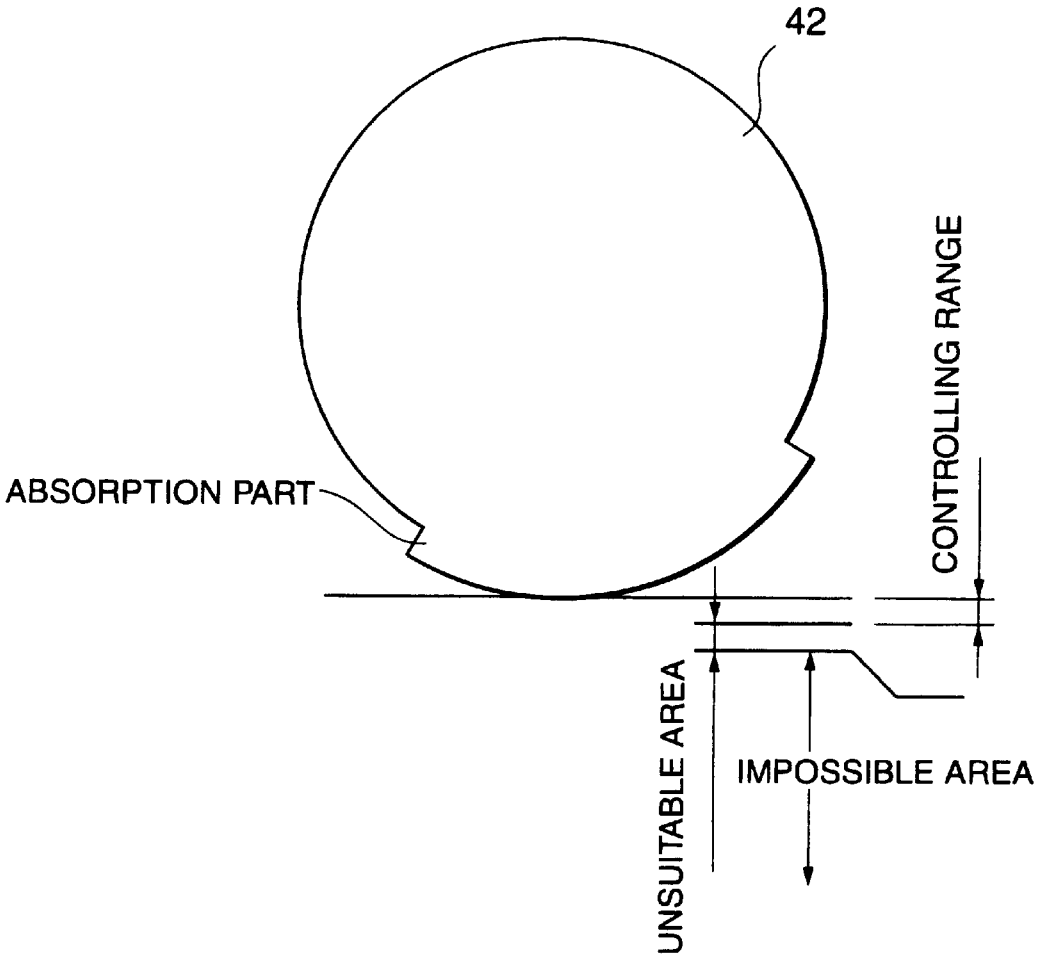
FIG. 8 is an explanatory view of a movable track of the lever.

As shown in FIG. 8, the moving track of the lever 31 includes a controlling area wherein the sheets are taken smoothly, a unsuitable area wherein taking troubles may happen and an impossible area wherein the sheets cannot be taken.

The next taking time t (see FIG. 6*a*) can be calculated by the signal (4). When the lever 31 cannot be moved to the controlling area at the taking time t, the controller 66 may control the motor 54 and the linear motor 32 so that the lever 31 is moved to the impossible area. When one taking operation is skipped over as described above, the controller 66 may also control the motor 54 and the linear motor 32 in the same manner.

A taking operation at a high speed is explained as below with reference to the FIG. 9.

Figure 9A:
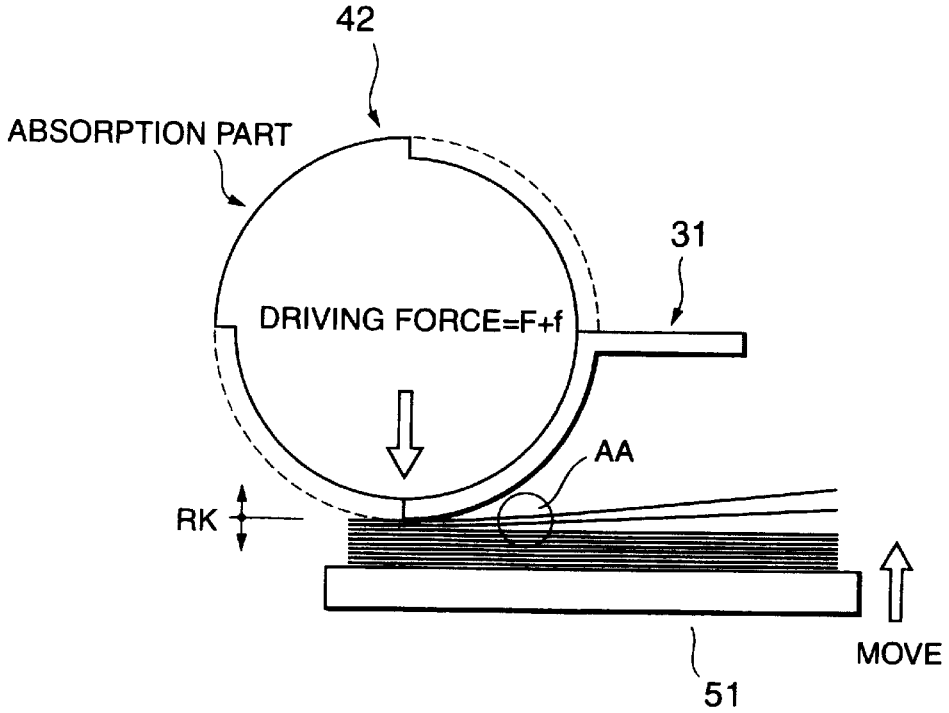
FIGS. 9*a* and 9*b* are explanatory views of an operation at a high speed of the embodiment of the sheet processing unit according to the invention.
Figure 9B:
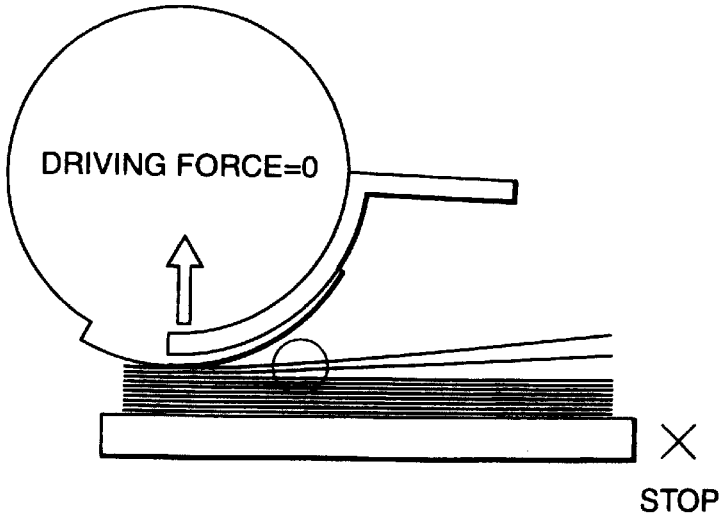

When the linear motor 32 is supplied a predetermined electric current, the linear motor 32 generates a driving force (a driving torque) to press the lever 31 to sheets 1 (downward in FIG. 9). Then, the sheet stage 51 is moved toward the rotor 42, and the sheets 1 contact with and are pressed to the lever 31. When a rotating torque of the lever 31 caused by the pressing increases over the driving torque, the lever 31 starts to rotate clockwise in FIG. 9.

During the lever 31 starts to rotate, the positioning sensor (not shown) measures the position of the lever 31. On the basis of the measured value, the sheet stage 51 is positioned so that the level of the lever 31 is equal to the level of the absorption part of the rotor 42. While the absorption part of the rotor 42 contacts with the sheet 1 (during the taking mode), the driving force to the lever 31 remains cancelled. The moving of the sheet stage 51 is also stopped. Then, the sheets are pressed by the rotor 42. While the absorption part of the rotor 42 does not contact with the top sheet 1 (during the positioning mode), the top sheet 1 can be positioned by the lever 31 to a desired position with a desired force, however long the distance is between the rotor 42 and the top sheet 1. This can prevent the sheets 1 from being pressed to the rotor 42 too much.

When the measured value of the position of the lever 31 reaches a predetermined value or within a predetermined range, the open-close units such as electromagnetic valves (not shown) for the chamber 41 and for a nozzle, which have been closed till then, are opened to enable the sheets 1 to be taken. At that time, airflow can be jetted from the nozzle or the like to a not-pressed portion of the sheets to promote to separate the sheets. The double-taking preventing unit (not shown) prevents a not-targeted sheet 1 from being taking when a targeted sheet 1 is taken.

As described above, the sheets 1 are pressed by the lever 31 as a preparatory step, and then the sheets 1 are lifted (supplied) and pressed to the rotor 42 while canceling the driving (pressing) force by the lever 31. Thus, the sheet 1 and the absorption part of the taking rotor 42 are assured to become in good contact with each other. Thus, the absorption force of the taking rotor 42 is efficiently transmitted to the sheet 1 to make the taking operation stable.

That is, a contacting state between the absorption part of the rotor 42 and the sheet 1, and a force transmitting state are detected as the pressing force while the sheet 1 is taken. RK in FIG. 9 means a distance between the absorption part of the rotor 42 and the top sheet 1 when the lever 31 is pressed to the sheets 1. In the case of a taking operation at a high speed, the RK is set within a range including zero or a minus value independently of the degree of the driving force. The minus value represents that the level of the top sheet is above the level of the absorption part.

Figure 10:
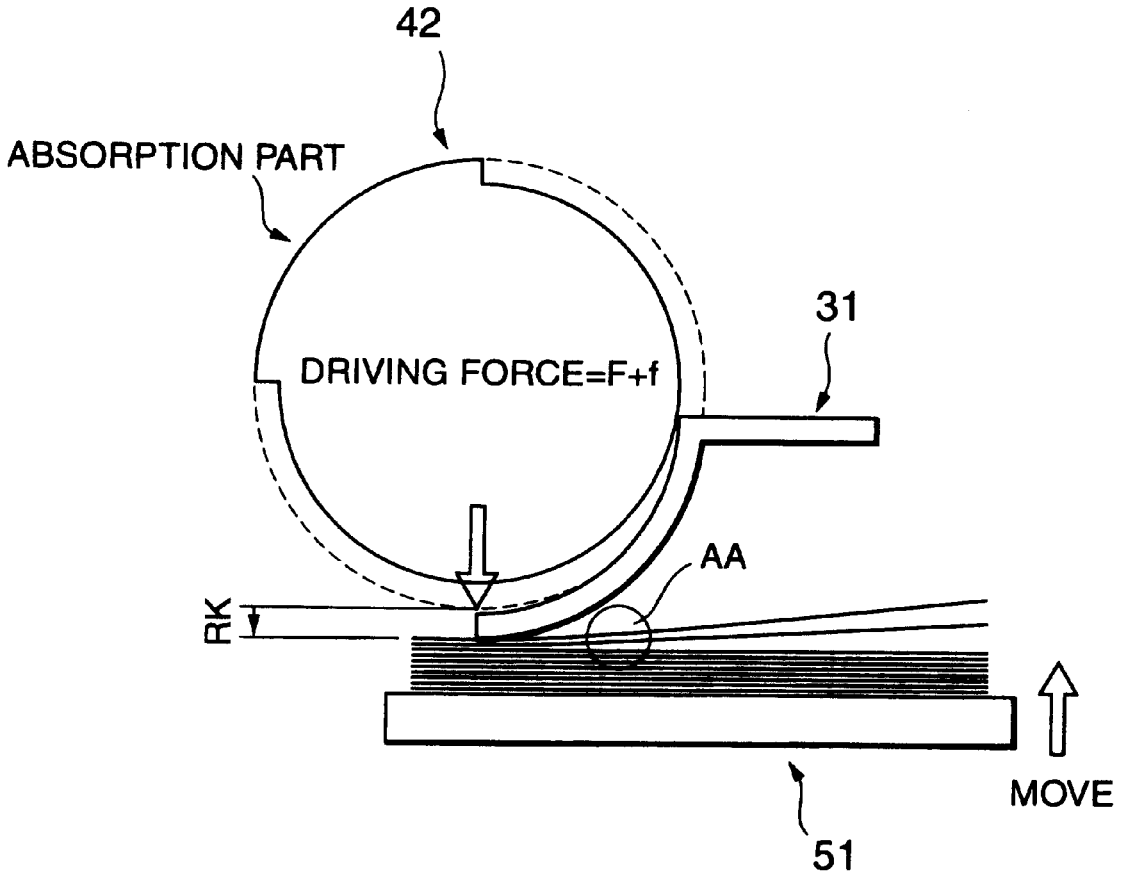
FIGS. 10 and 11 are explanatory views of an operation at a low speed of the embodiment of the sheet processing unit according to the invention.
Figure 11:
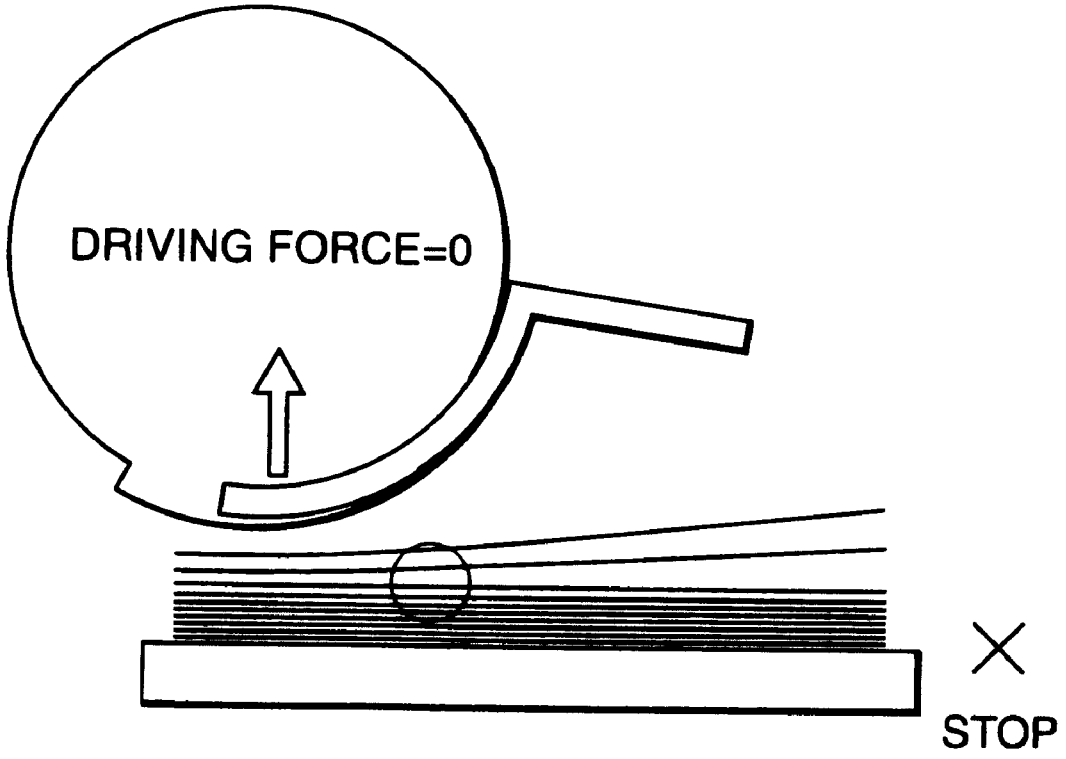

A taking operation at a low speed is explained as below with reference to the FIGS. 10 and 11.

When the speed of the taking operation is low, a non-targeted sheet just below a top targeted sheet is liable to be pulled or taken with the targeted sheet. In order to prevent this, it is preferable that the RK is a large value. The absorption of the top sheet is stable when the rotor 42 rotates at a low speed even if the RK is a large value. In the case of a taking operation at a low speed, the RK is set within a range defined in consideration for the stability of the absorption and the frequency of the pulled or taken states. The driving force is set in the same manner.

Second Embodiment

Figure 12:
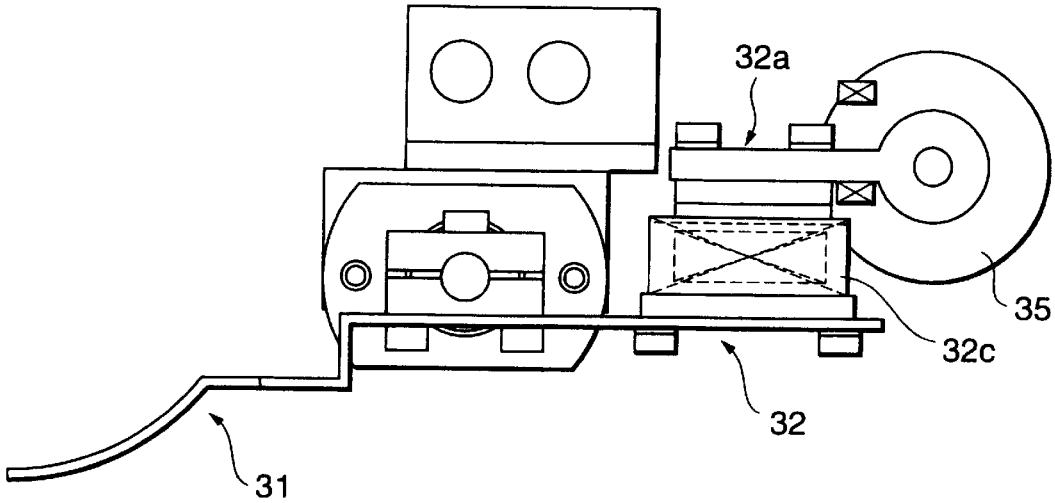
FIG. 12 is a side view of a detecting unit of second embodiment of the sheet processing unit according to the invention.

The second embodiment of the detecting unit (lever) of the sheet processing unit is explained with reference to FIG. 12. FIG. 12 is a side view of a detecting unit of the second embodiment of the sheet processing unit according to the invention. The reference numerals used in the second embodiment are the same as in the first embodiment. The explanations of the same elements as the first embodiment are omitted.

In the second embodiment, the driving unit for giving a driving force to the lever has: a linear motor 32 having a coil 32*c*, a magnet 32*a* capable of influencing the coil 32*c*, and a moving mechanism capable of moving the magnet 32*a* at a high speed. The moving mechanism is materialized by a solenoid mechanism capable of rotating at a high speed.

According to the second embodiment, the coil 32*c* can be separated from the magnet 32*a* at a high speed. Thus, the taking control can be achieved at a high speed.

Third Embodiment

Figure 13:
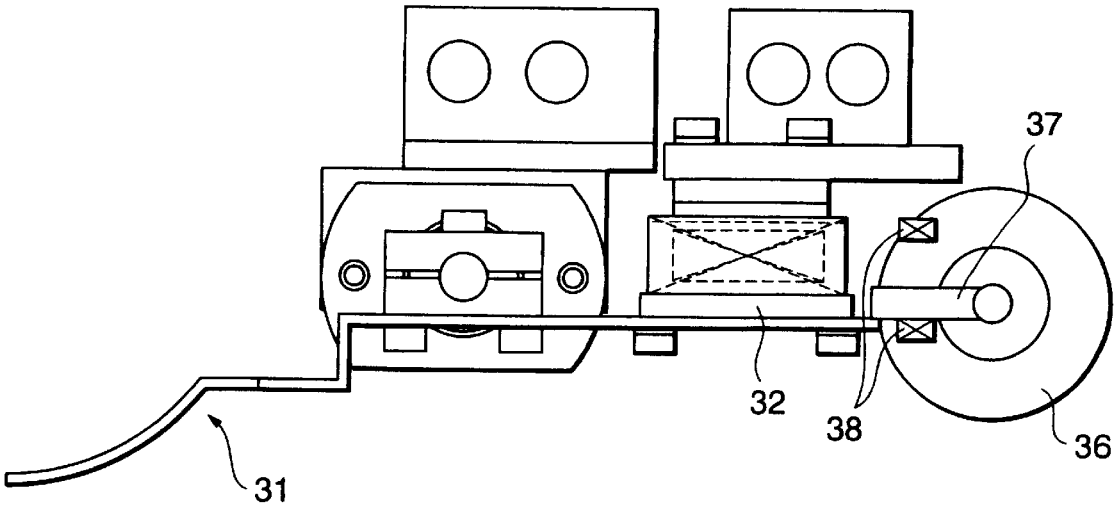
FIG. 13 is a side view of a detecting unit of third embodiment of the sheet processing unit according to the invention.

The third embodiment of the detecting unit (lever) of the sheet processing unit is explained with reference to FIG. 13.

In the third embodiment, a stopper 37 is provided for regulating a movable range of the movable lever 31 in the concave portion of the rotor (rotatable roller). The stopper 37 is connected to a rotatable solenoid 36. The solenoid 36 can remove the stopper 37 as a stopper remover. The position of the stopper 37 may be changed. The changeable range of the position of the stopper 37 is regulated by two other stoppers 38. More detailed positioning can be achieved by using a mechanism consisting of a linear slider and a ball-screw and a motor.

According to the third embodiment, the taking control can be achieved at a high speed by appropriately adjusting the position of the stopper 37.

Fourth Embodiment

Figure 14A:
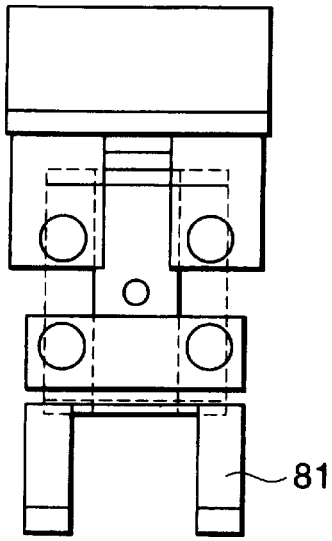
FIGS. 14*a* and 14*b* are a front view and a side view of a detecting unit of fourth embodiment of the sheet processing unit according to the invention.
Figure 14B:
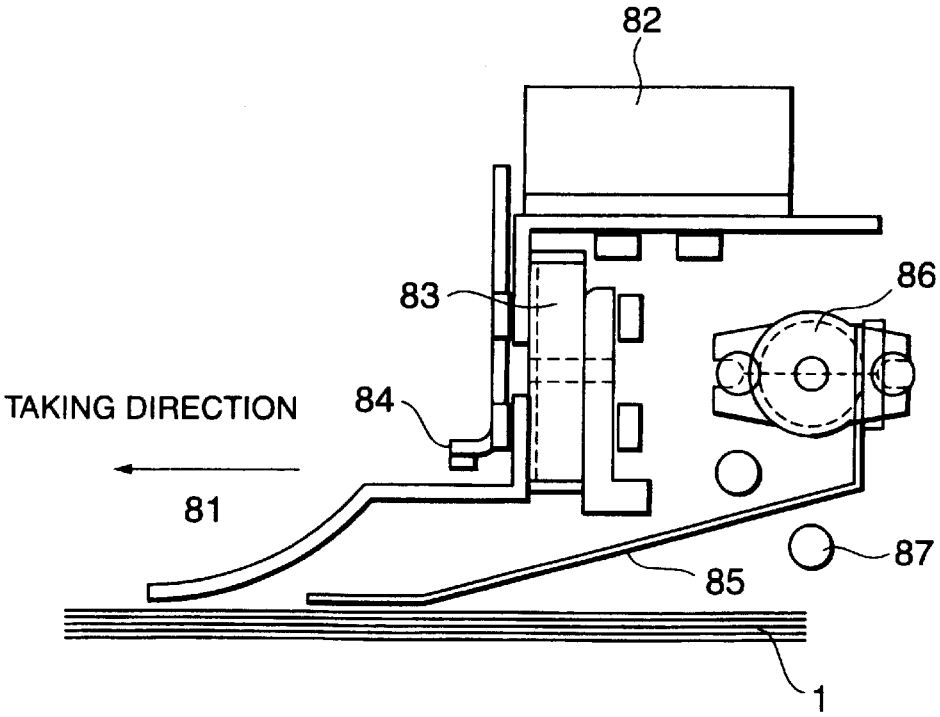

The fourth embodiment of the sheet processing unit is explained with reference to FIGS. 14*a* and 14*b*. FIG. 14*a* is a front view of a detecting unit of the fourth embodiment of the sheet processing unit according to the invention. FIG. 14*b* is a side view of the detecting unit of the fourth embodiment of the sheet processing unit according to the invention.

A lever 81 is connected to a linear guide 83 to move in a direction perpendicular to the taking direction of the sheets 1. Thus, the lever 81 is not likely to be moved by the frictional force by the taken sheet 1. That is, disturbance of the movement of the lever 81 is effectively prevented.

As shown in FIGS. 14*a* and 14*b*, the curvature (shape) of the lever 81 is the same as the curvature (shape) of the absorption part of the taking rotor (not shown). Thus, the state wherein the sheets 1 press the lever 81 is substantially the same as the state wherein the absorption of the rotor (not shown) presses the lever 81.

In the fourth embodiment, another rotatable lever 85 is arranged in a row with the lever 81. The rotatable lever 85 is connected to the rotatable damper 86. Thus, the rotatable lever 85 serves as a damper for reducing down a disturbance of the sheets 1. A movable range of the lever 85 is regulated by stoppers 87.

According to the fourth embodiment, the disturbance of the sheets 1 can be effectively reduced down without falling a responsibility of the lever 81. Thus, stable positioning and stable taking can be achieved.

Fifth Embodiment

Figure 15:
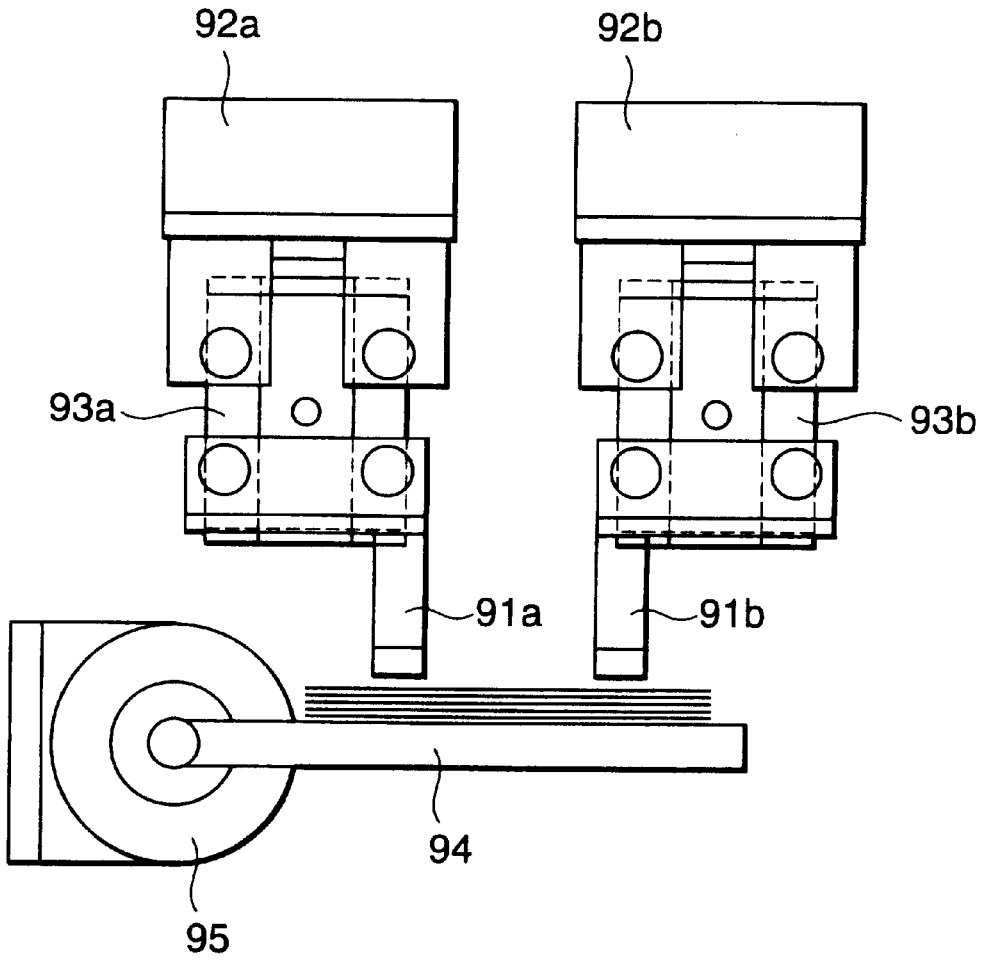
FIG. 15 is a side view of a taking part of fifth embodiment of the sheet processing unit according to the invention.

The fifth embodiment of the sheet processing unit is explained with reference to FIG. 15. FIG. 15 is a side view of a taking part of the fifth embodiment of the sheet processing unit according to the invention.

In the embodiment, two pressure detecting levers 91*a*, 91*b* are arranged at a predetermined interval. The two levers 91*a*, 91*b* can detect a state of the piled sheets 1 respectively. This arrangement is advantageous when an uppermost sheet 1 of the piled sheets is undulated. That is, even when two detected states are relatively different, the respective pressing forces of the respective levers and/or the sheet supplying operation may be controlled and adjusted to carry out the smooth taking operation of the sheets 1 based on the respective detected states.

As shown in FIG. 15, it is more advantageous that the sheet stage 94 placing the piled sheets 1 is connected to the sheet supplying driver (not shown) via an actuator 95 to control an inclination of the sheet stage 94.

Sixth Embodiment

Figure 16A:
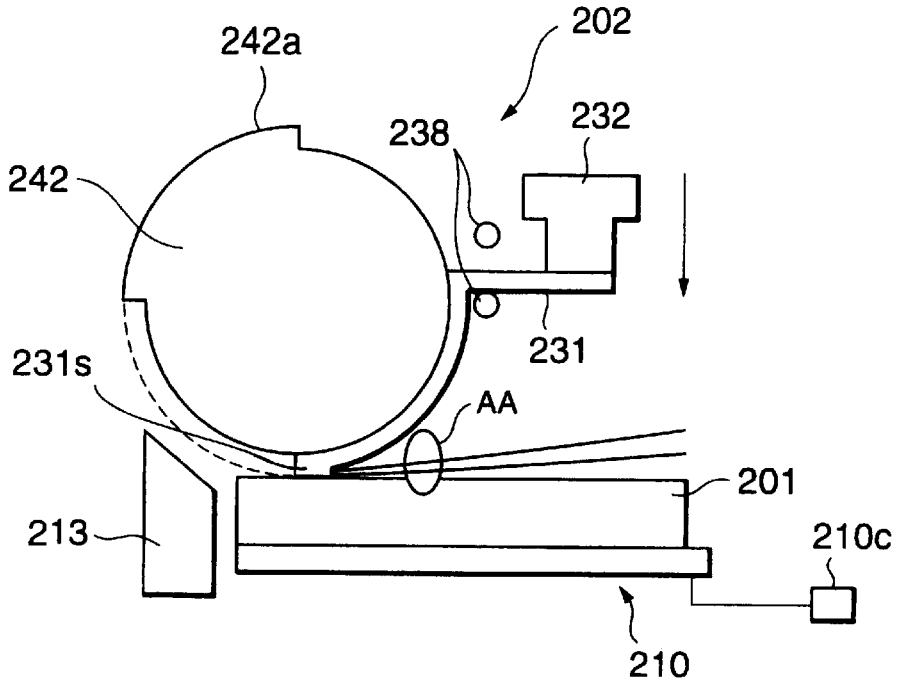
FIGS. 16*a* and 16*b* are side views of a taking part of sixth embodiment of the sheet processing unit according to the invention.
Figure 16B:
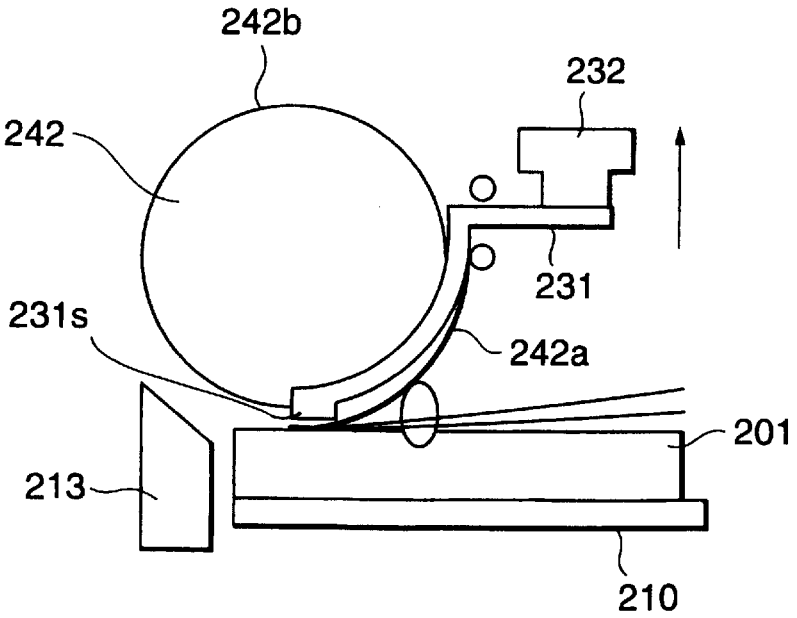

The sixth embodiment of the sheet processing unit is explained with reference to FIGS. 16*a* and 16*b*. FIGS. 16*a* and 16*b* are side views of a taking part of the sixth embodiment of the sheet processing unit according to the invention.

The sheet processing unit of the sixth embodiment also includes: a taking part for taking sheets one by one from piled sheets, a conveying part for conveying the taken sheets, and a processing part for carrying out a process to the conveyed sheets.

As shown in FIGS. 16*a* and 16*b*, the taking part 202 of the sixth embodiment has: a rotor (rotatable roller) 242 as a taking unit for coming in contact with the piled sheets 201 to generate a taking force and to take the sheets 201 one by one with the taking force, a movable lever 231 arranged in a side of the rotor 242 with respect to the piled sheets 201, a linear motor and a position sensor (not shown) (a positioning unit) 232 for positioning the movable lever 231 at a predetermined position, a pressure sensor 231*s* provided on a surface of the movable lever 231 facing to the piled sheets 201 for detecting a pressure to the piled sheets 201 a sheet supplying unit 210 for supplying the piled sheets 201 to the rotor 242, and a sheet supplying unit controller 210*c* for controlling the sheet supplying unit 210 on the basis of the pressure detected by the pressure sensor 231*s*.

The rotor 242 has an operating part 242*a* for generating the taking force, and a concave portion 242*b* having a smaller diameter than the operating part 242*a*. The movable lever 231 is movable into the concave portion 242*b*. A movable range of the movable lever 231 is regulated by stoppers 238 and in addition, the stoppers may be positioned by positioning unit. A double-taking preventing unit 213 is disposed adjacent to the rotor 242.

The movable lever 231 has a portion capable of coming in contact with the sheets 201, and the portion has a curvature the same as a curvature of the operating part 232*a*.

According to the sixth embodiment, the sheets 201 are accurately positioned since the sheet supplying unit 210 is controlled based on the value or values detected by the pressure sensor 232*s* at a desired position.

In addition, as shown in FIG. 16*b*, it is preferable that the movable lever 231 can be moved synchronously with the rotational timings of the rotor. Thus, the lever 231 can be evacuated not to disturb the taking operation during the taking mode.

Seventh Embodiment

Figure 17A:
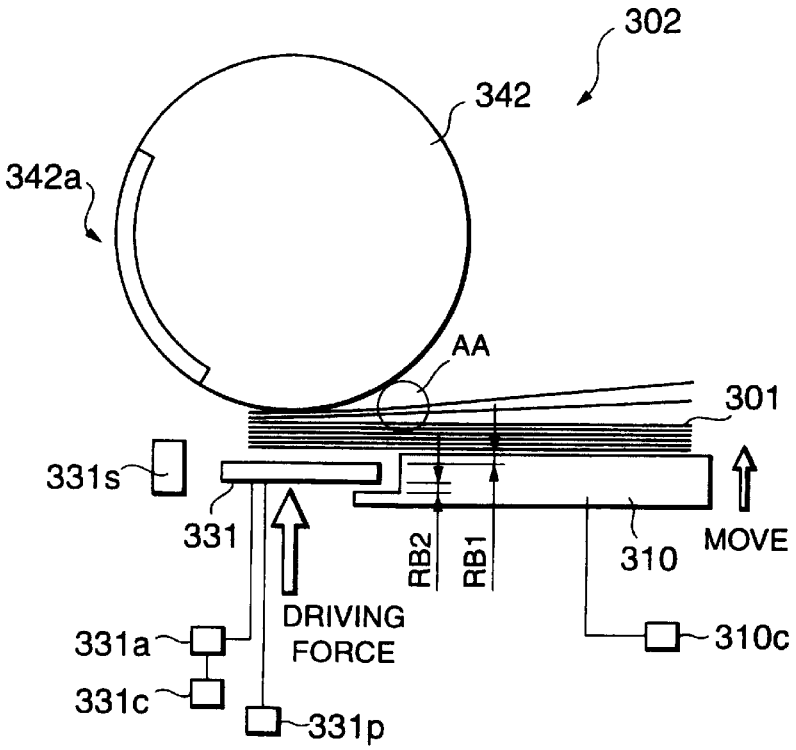
FIGS. 17*a* and 17*b* are side views of a taking part of seventh embodiment of the sheet processing unit according to the invention.
Figure 17B:
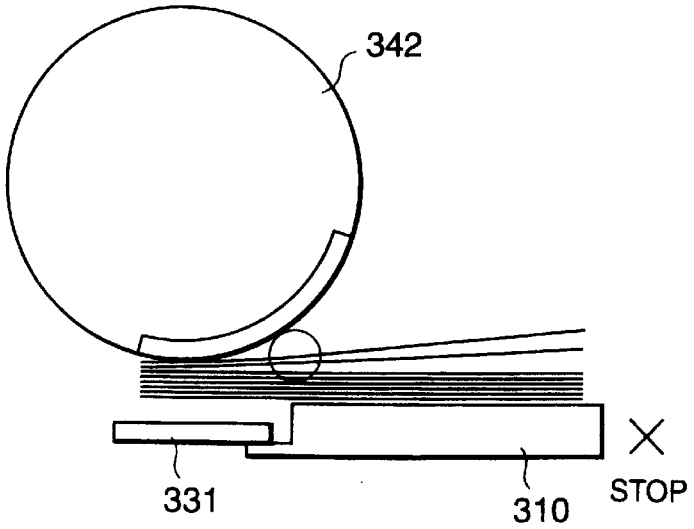

The seventh embodiment of the sheet processing unit is explained with reference to FIGS. 17*a* and 17*b*. FIGS. 17*a* and 17*b* are side views of a taking part of the seventh embodiment of the sheet processing unit according to the invention.

The sheet processing unit of the seventh embodiment also includes: a taking part for taking sheets one by one from piled sheets, a conveying part for conveying the taken sheets, and a processing part for carrying out a process to the conveyed sheets.

As shown in FIGS. 17*a* and 17*b*, the taking part 302 of the seventh embodiment has: a taking unit 342 for generating an absorption force to come in contact with the piled sheets 301, to generate a taking force and to take the sheets 301 one by one with the taking force, a sheet supplying unit 310 for supplying the piled sheets 301 to the taking unit 342, and a movable lever 331 provided on the sheet supplying unit 310 for supporting a front end portion of the piled sheets 301 with respect to a conveying direction, a driving unit 331*a* for giving a driving force in a linear or rotational direction to the movable lever 331, a force controller 331*c* for controlling the driving force given to the movable lever 331 by the driving unit 331*a*, a detecting unit 331*s* for detecting a position or a velocity or an acceleration of the movable lever 331 a sheet supplying unit controller 310*c* for controlling the sheet supplying unit 310 on the basis of the value or values detected by the detecting unit 331*s,* and a lever positioning unit 331*p* for positioning the movable lever 331 at a predetermined position.

The lever positioning unit 331*p* positions the movable lever 331 at a position away from the taking unit 342 by a predetermined distance RB2 in cooperation with the taking unit 342 when the taking unit 342 generates the absorption force toward a portion of the piled sheets 301. The distance RB2 is a controllable range at a positioning mode. The taking unit 342 has a rotor (rotatable roller), and the rotor has an operating part 342*a* for generating a taking force. The lever positioning unit 331P can be materialized by the driving unit 321*a* (linear motor or the like) and the force controller 331*c* and the detecting unit 331*s*.

According to the seventh embodiment, a smooth taking operation can be achieved by actively moving the movable lever 331 away from the rotor 342 when the taking unit 342 generates the absorption force toward the piled sheets 301.

Eighth Embodiment

Figure 18A:
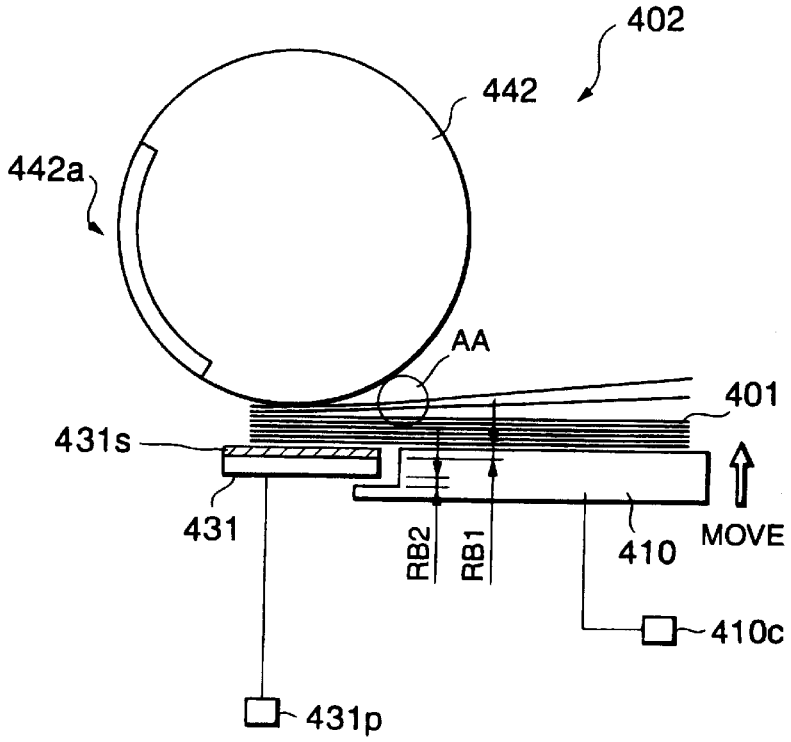
FIGS. 18*a* and 18*b* are side views of a taking part of eighth embodiment of the sheet processing unit according to the invention.
Figure 18B:
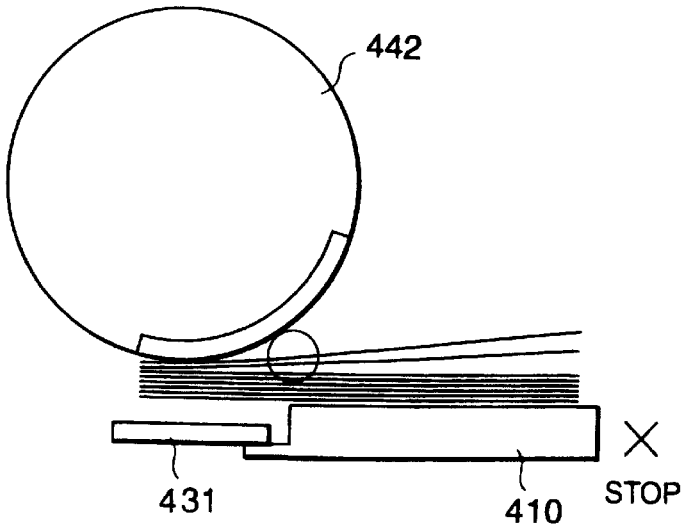

The eighth embodiment of the sheet processing unit is explained with reference to FIGS. 18*a* and 18*b*. FIGS. 18*a* and 18*b* are side views of a taking part of the eighth embodiment of the sheet processing unit according to the invention.

The sheet processing unit of the eighth embodiment also includes: a taking part for taking sheets one by one from piled sheets, a conveying part for conveying the taken sheets, and a processing part for carrying out a process to the conveyed sheets. As shown in FIGS. 18*a* and 18*b*, the taking part 402 of the eighth embodiment has: a taking unit 442 for generating an absorption force to come in contact with the piled sheets 401, to generate a taking force and to take the sheets 401 one by one with the taking force, a sheet supplying unit 410 for supplying the piled sheets 401 to the taking unit 442, and a movable lever 431 provided on the sheet supplying unit 410 for supporting a front end portion of the piled sheets 401 with respect to a conveying direction, a pressure sensor 431*s* provided on a surface of the movable lever 431 facing to the piled sheets 401 for detecting a pressure to the piled sheets 401, a lever positioning unit 431P for positioning the movable lever 431 at a predetermined position, and a sheet supplying unit controller 410C for controlling the sheet supplying unit 410 on the basis of the values detected by the pressure sensor 431*s* at a desired position.

The lever positioning unit 431P positions the movable lever 431 at a position away from the taking unit 442 by a predetermined distance RB2 in cooperation with the taking unit 442 when the taking unit 442 generates the absorption force toward a portion of the piled sheets 401. The distance RB2 is a controllable range at a positioning mode. The taking unit 442 has a rotor (rotatable roller), and the rotor has an operating part 442*a* for generating a taking force. The lever positioning unit 431P can be materialized by the driving unit (not shown) for giving a driving force in a linear or rotational direction to the movable lever 431 (not shown) and the force controller for controlling the driving force given to the movable lever 431 by the driving unit (not shown) and the detecting unit (not shown) for detecting a position or a velocity or an acceleration of the movable lever 431.

According to the eighth embodiment, a smooth taking operation can be achieved by actively moving the movable lever 431 away from the rotor 442 when the taking unit 442 generates the absorption force toward the piled sheets 401.

Ninth Embodiment

Figure 19A:
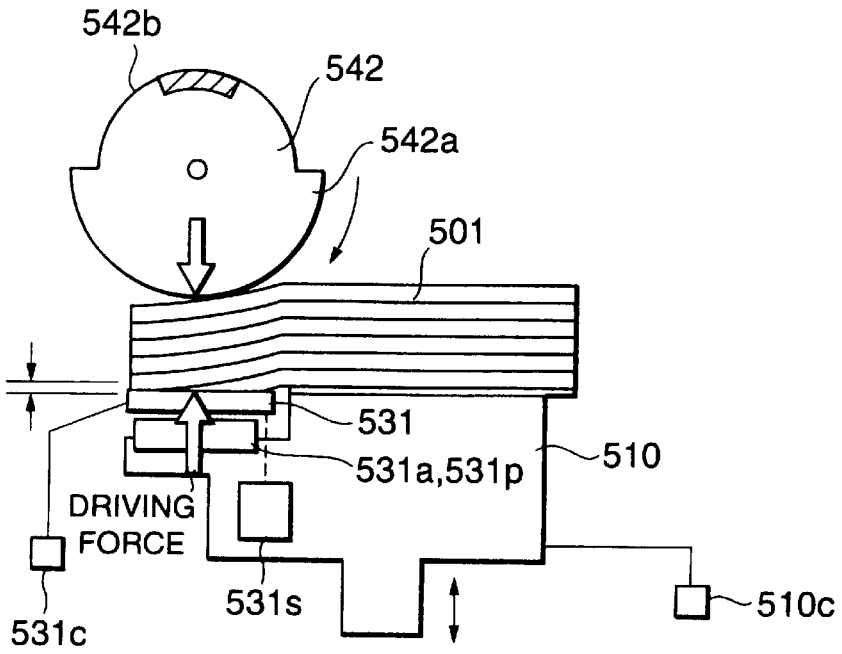
FIGS. 19*a* and 19*b* are side views of a taking part of ninth embodiment of the sheet processing unit according to the invention.
Figure 19B:
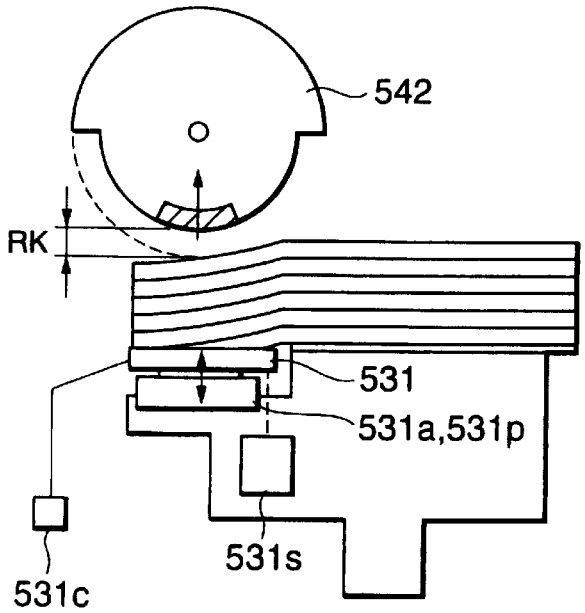

The ninth embodiment of the sheet processing unit is explained with reference to FIGS. 19*a* and 19*b*. FIGS. 19*a* and 19*b* are side views of a taking part of the ninth embodiment of the sheet processing unit according to the invention.

The sheet processing unit of the ninth embodiment also includes: a taking part for taking sheets one by one from piled sheets, a conveying part for conveying the taken sheets, and a processing part for carrying out a process to the conveyed sheets.

As shown in FIGS. 19*a* and 19*b*, the taking part 502 of the ninth embodiment has: a taking unit 542 having a convex portion 542*a* for pressing the sheets 501 to adjust attitudes of the sheets 501 and a concave portion 542*b* for generating an absorption force to come in contact with the sheets 501, to generate a taking force and to take the sheets 501 one by one with the taking force, said convex portion 542*a* and said concave portion 542*b* repeatedly face to the piled sheets 501 by turns, a sheet supplying unit 510 for supplying the piled sheets 501 to the taking unit 542, a movable lever 531 provided on the sheet supplying unit 510 for supporting a front end portion of the piled sheets 501 with respect to a conveying direction, a driving unit 531*a* for giving a driving force in a linear or rotational direction to the movable lever 531, a force controller 531*c* for controlling the driving force given to the movable lever 531 by the driving unit 531*a,* a detecting unit 531*s* for detecting a position or a velocity or an acceleration of the movable lever 531, a sheet supplying unit controller 510*c* for controlling the sheet supplying unit 510 on the basis of the value or values detected by the detecting unit 531*s,* and a lever positioning unit 531*p* for positioning the movable lever 531 at a predetermined position.

The lever positioning unit 531P can be materialized by the driving unit 531*a* (linear motor or the like) and the force controller 531C and the detecting unit 531*s*.

In the ninth embodiment, the taking unit 542 has a rotor (rotatable roller), the convex portion 542*a* is a portion having a larger diameter of the rotatable roller, and the concave portion 542*b* is a portion having a smaller diameter of the rotatable roller.

According to the ninth embodiment, a smooth taking operation can be achieved since the piled sheets 501 becomes away from the rotor 542 by a distance RK, which is a height of the convex portion 542*a,* when the rotor 542 generates the absorption force toward a portion of the piled sheets 401.

In addition, the upper surface of the piled sheets is preferably adapted to be not pressed by the concave portion, for example by measuring a position of the upper surface thereof with respect to the taking unit by means of a positioning sensor such as a light sensor, and by cooperating with the rotational timings of the rotor.

Tenth Embodiment

Figure 20A:
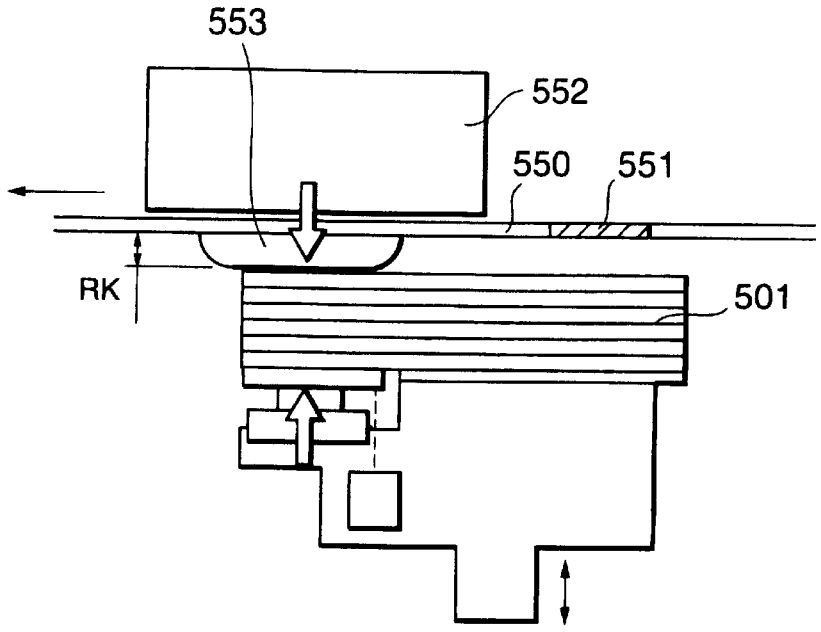
FIGS. 20*a* and 20*b* are side views of a taking part of tenth embodiment of the sheet processing unit according to the invention.
Figure 20B:
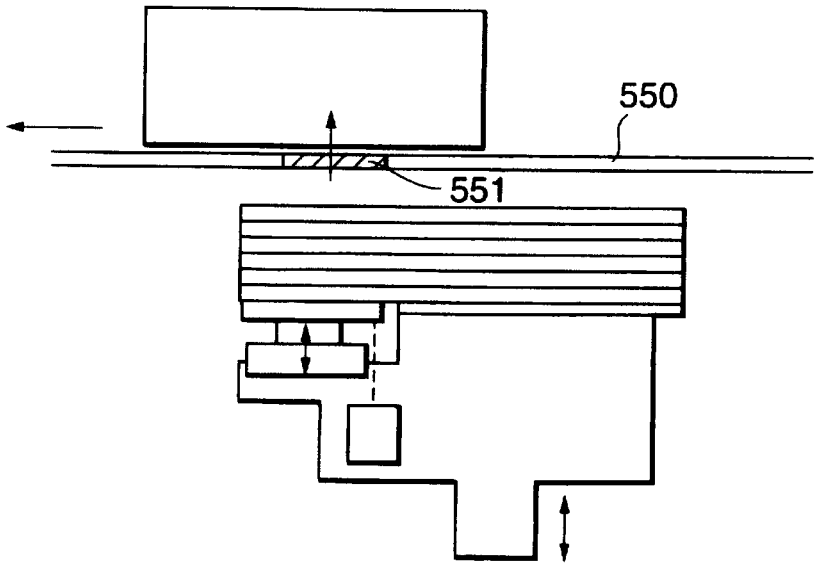

The tenth embodiment of the sheet processing unit is explained with reference to FIGS. 20*a* and 20*b*. FIGS. 20*a* and 20*b* are side views of a taking part of the tenth embodiment of the sheet processing unit according to the invention.

In the tenth embodiment, the taking unit has a moving absorption belt 550 instead of the rotatable roller 542. The moving absorption belt 550 has absorption holes 551 and pressing pads (protrusions) 553. The absorption belt 550 generates an absorption force when the absorption holes 551 face to the opening of the vacuum chamber 552. Other elements and portions are the same as the ninth embodiment.

According to the tenth embodiment, a smooth taking operation can be achieved since the piled sheets 501 becomes away from the absorption belt 550 by a distance RK, which is a height of the pressing pad 553, when the absorption belt 550 generates the absorption force toward a portion of the piled sheets 501.

Eleventh Embodiment

Figure 21A:
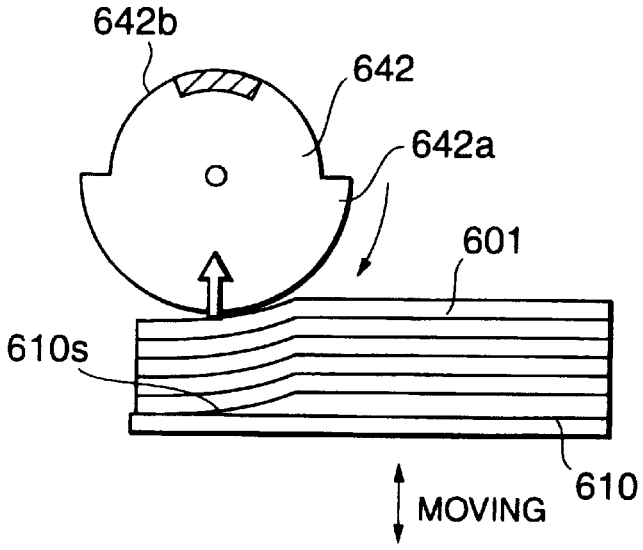
FIGS. 21*a* and 21*b* are side views of a taking part of eleventh embodiment of the sheet processing unit according to the invention.
Figure 21B:
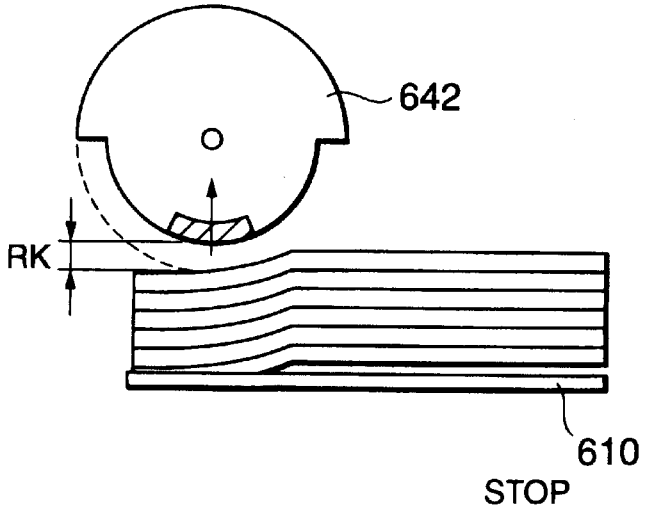

The eleventh embodiment of the sheet processing unit is explained with reference to FIGS. 21*a* and 21*b*. FIGS. 21*a* and 21*b* are side views of a taking part of the eleventh embodiment of the sheet processing unit according to the invention.

The sheet processing unit of the eleventh embodiment also includes: a taking part for taking sheets one by one from piled sheets, a conveying part for conveying the taken sheets, and a processing part for carrying out a process to the conveyed sheets.

As shown in FIGS. 21*a* and 21*b*, the taking part 602 of the eleventh embodiment has: a taking unit 642 having a convex portion 642*a* for pressing the sheets 601 to adjust attitudes of the sheets 601 and a concave portion 642*b* for generating an absorption force to come in contact with the sheets 601, to generate a taking force and to take the sheets 601 one by one with the taking force, said convex portion 642*a* and said concave portion 642*b* repeatedly face to the piled sheets 601 by turns, a sheet supplying unit 610 for supplying the piled sheets 601 to the taking unit 642, a pressure sensor 610*s* provided on a portion of the sheet supplying unit 610 for detecting a pressure from the piled sheets 601, the portion supporting a front end portion of the piled sheets 601 with respect to a conveying direction, and a sheet supplying unit controller 610*c* for controlling the sheet supplying unit 610 on the basis of the pressure detected by the pressure sensor 610*s*.

In the eleventh embodiment, the taking unit 642 has a rotor (rotatable roller), the convex portion 642*a* is a portion having a larger diameter of the rotatable roller, and the concave portion 642*b* is a portion having a smaller diameter of the rotatable roller.

According to the eleventh embodiment, a smooth taking operation can be achieved since the piled sheets 601 becomes away from the rotor 642 by a distance RK, which is a height of the convex portion 642*a,* when the rotor 642 generates the absorption force toward a portion of the piled sheets 601.

Twelfth Embodiment

Figure 22A:
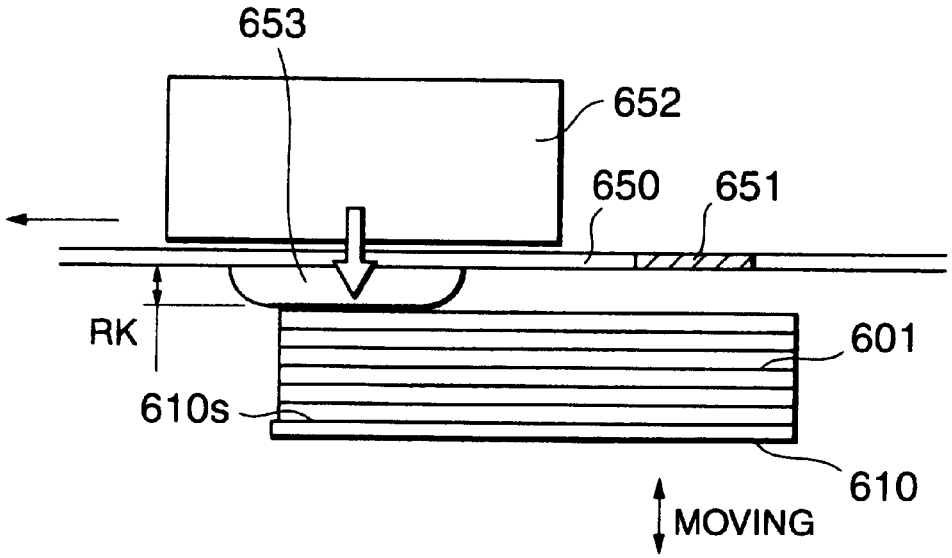
FIGS. 22*a* and 22*b* are side views of a taking part of twelfth embodiment of the sheet processing unit according to the invention.
Figure 22B:
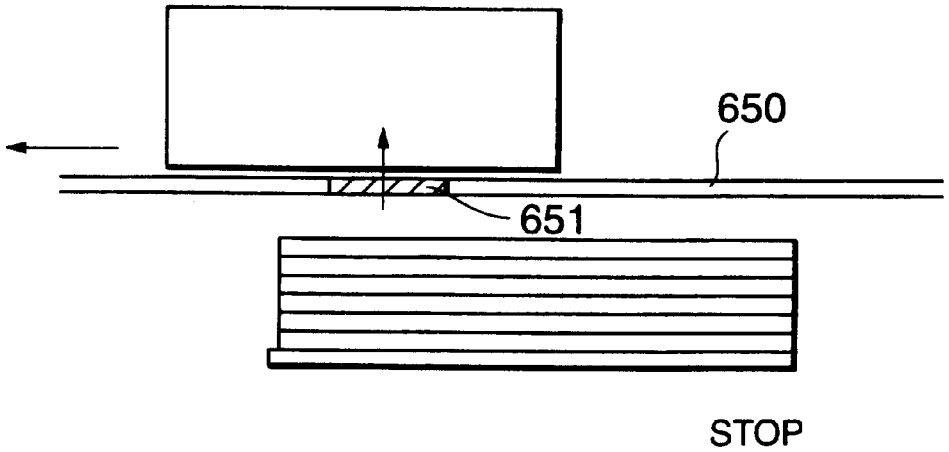
Figure 23:
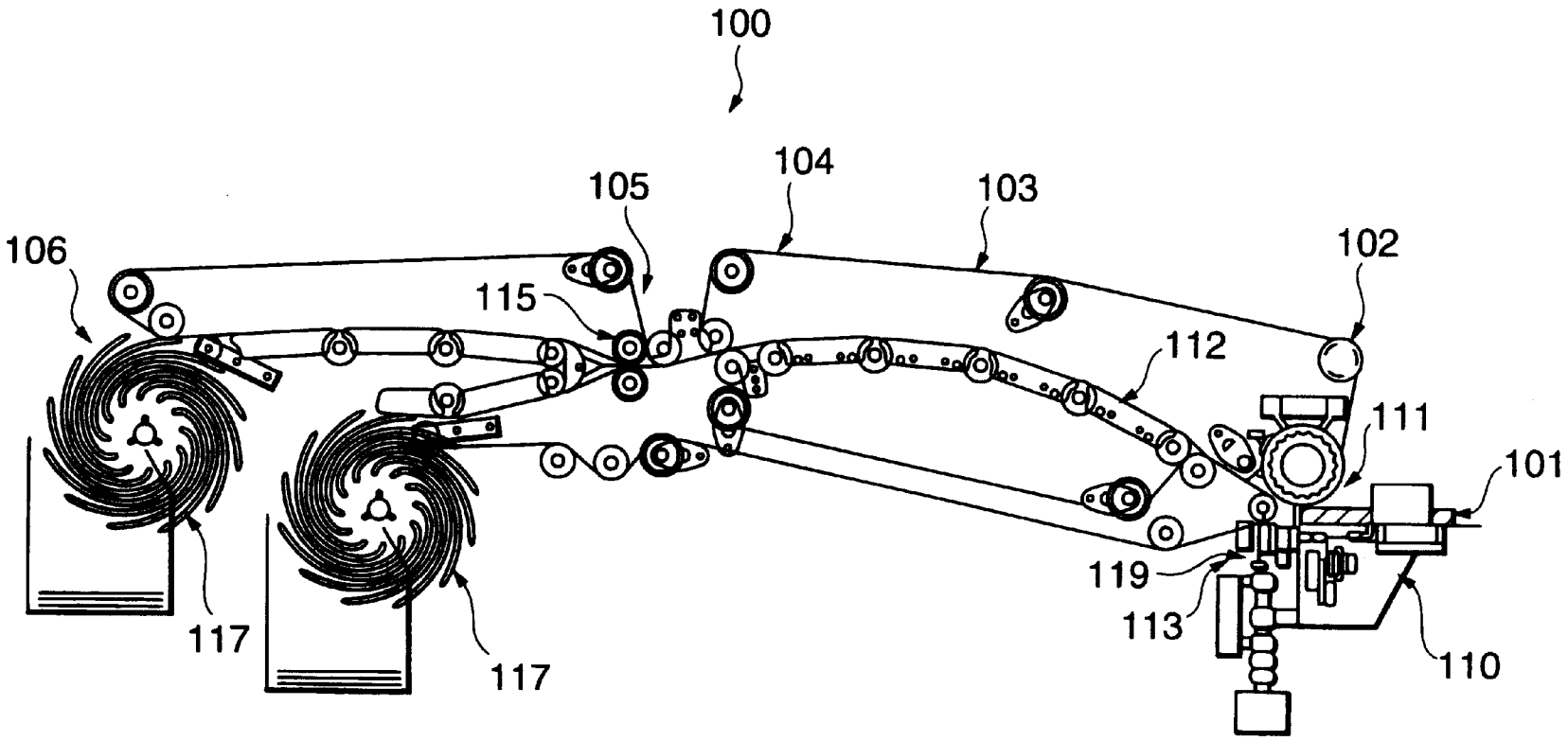
FIG. 23 is a schematically view of a conventional sheet processing unit.
Figure 24:
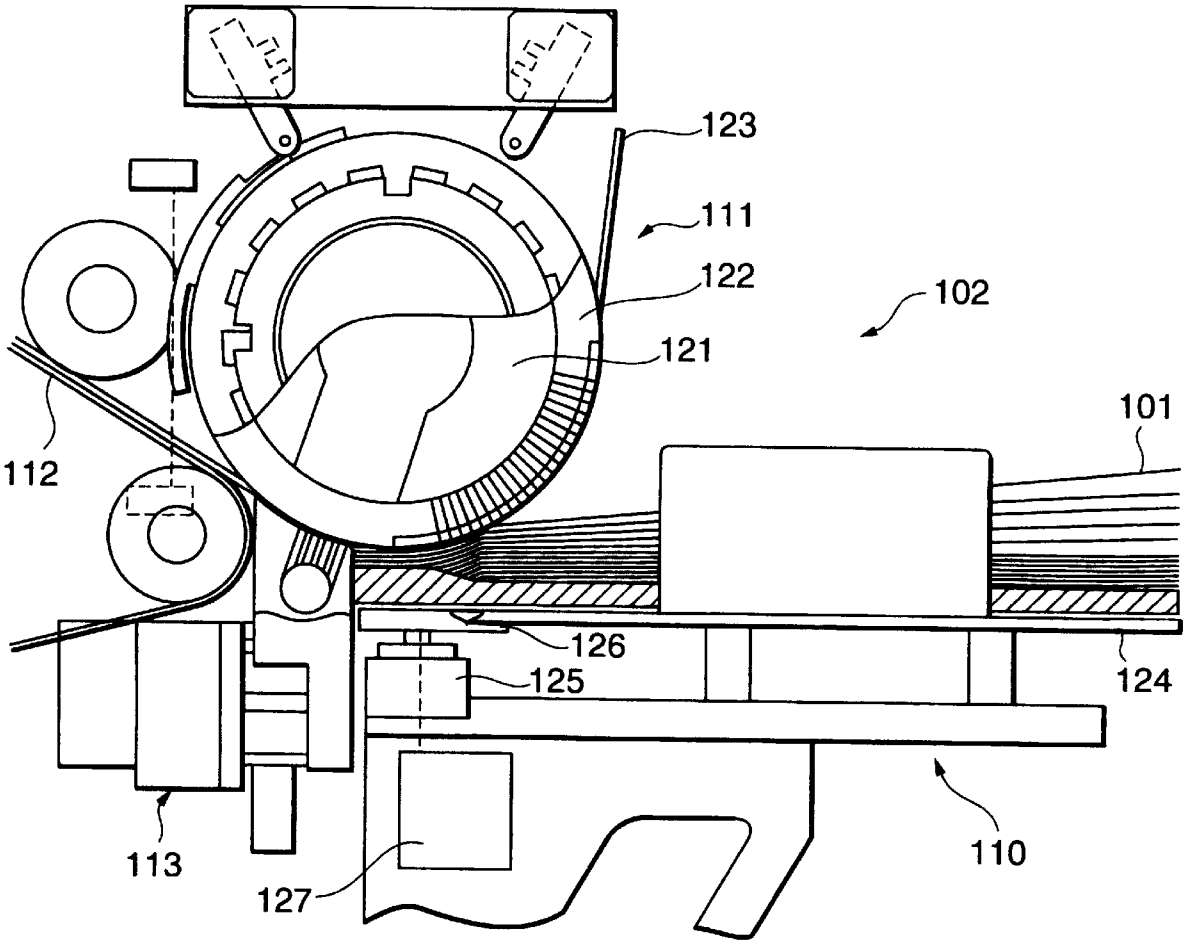
FIG. 24 is an enlarged view of a taking part of the conventional sheet processing unit.

The twelfth embodiment of the sheet processing unit is explained with reference to FIGS. 22*a* and 22*b*. FIGS. 22*a* and 22*b* are side views of a taking part of the twelfth embodiment of the sheet processing unit according to the invention.

In the twelfth embodiment, the taking unit has a moving absorption belt 650 instead of the rotatable roller 642. The moving absorption belt 650 has absorption holes 651 and pressing pads (protrusions) 653. The absorption belt 650 generates an absorption force when the absorption holes 651 face to the opening of the vacuum chamber 652. Other elements and portions are the same as the eleventh embodiment.

According to the twelfth embodiment, a smooth taking operation can be achieved since the piled sheets 601 becomes away from the absorption belt 650 by a distance RK, which is a height of the pressing pad 653, when the absorption belt 650 generates the absorption force toward a portion of the piled sheets 601.

This invention is not limited by the above embodiments. The embodiments may be modified within the scope of the claimed invention. For example, the linear motor or the solenoid may be replaced with another actuator which may serves as the linear motor or the solenoid.

The piled sheets may be piled in any direction, which include a vertical direction or a horizontal direction.

The taking unit may include a vacuum absorption rotor, or a vacuum absorption belt, or a frictional roller, or the like.

What is claimed is:

1. A sheet processing unit, comprising:

a taking part for taking sheets one by one from piled sheets, a conveying part for conveying the taken sheets, and a processing part for carrying out a process to the conveyed sheets, the said taking part having:

a taking unit for coming in contact with the piled sheets to generate a taking force and to take the sheets one by one with the taking force, a movable lever arranged in a side of the taking unit with respect to the piled sheets, a driving unit for giving a driving force in a linear or rotational direction to the movable lever, a force controller for controlling the driving force given to the movable lever by the driving unit, a detecting unit for detecting a position of the movable lever, a sheet supplying unit for supplying the piled sheets to the taking unit, and a sheet supplying unit controller for controlling the sheet supplying unit on the basis of the position of the movable lever detected by the detecting unit.

2. A sheet processing unit according to claim 1, wherein:

the taking unit has a rotatable roller, the rotatable roller has an operating part for generating the taking force and a concave portion having a smaller diameter than the operating part, and the movable lever is movable into the concave portion.

3. A sheet processing unit according to claim 2, wherein:

the rotatable roller is driven by a belt, and the belt has a function for conveying the sheets, and is arranged in such a manner that the belt is away from the sheets when the position of the movable lever is detected.

4. A sheet processing unit according to claim 2, wherein:

the operating part has a curvature, the movable lever has a portion capable of coming in contact with the sheets, and the portion having a curvature the same as the curvature of the operating part.

5. A sheet processing unit according to claim 2, wherein:

the taking unit takes the sheets by repeating a cycle, the cycle including:

a positioning mode wherein the operating part is away from the sheets and the movable lever presses and positions the sheets, and a taking mode wherein the operating part comes in contact with the sheets and the movable lever gives no driving force to the sheets.

6. A sheet processing unit according to claim 5, wherein:

the taking unit has a function to automatically adjust a timing of the cycle by temporarily stop the cycle when the sheets are not positioned in a predetermined range in the positioning mode.

7. A sheet processing unit according to claim 1, further comprising a second detecting unit for detecting at least one of a velocity and an acceleration of the movable lever, wherein:

the sheet supplying unit controller controls the sheet supplying unit on the basis of at least one of the velocity and the acceleration and the force controller controls the driving force by the driving unit on the basis of the movable lever detected by the second detecting unit.

8. A sheet processing unit according to claim 1, wherein:

the force controller controls the driving force by the driving unit based on at least one of a thickness of the piled sheets, a number of the sheets and a frictional coefficient of the sheets.

9. A sheet processing unit according to claim 1, wherein:

the sheet supplying unit controller controls the sheet supplying unit based on at least one of a taking pitch of the sheets, a taking gap of the sheets, a state of skews of the sheets, a state of slides of the sheets, a state of slide values of the sheets and a state of double-takings of the sheets, and the force controller controls the driving force by the driving unit based on at least one of the taking pitch of the sheets, the state of the skews of the sheets, the state of the slides of the sheets, the state of the slide values of the sheets and the state of the double-takings of the sheets.

10. A sheet processing unit according to claim 1, further comprising a measuring unit for measuring at least one of a position, a velocity and an acceleration of the sheet supplying unit, wherein:

the sheet supplying unit controller controls the sheet supplying unit based on at least one of the position, the velocity and the acceleration of the sheet supplying unit measured by the measuring unit, and the force controller controls the driving force by the driving unit based on at least one of the position, the velocity and the acceleration of the sheet supplying unit measured by the measuring unit.

11. A sheet processing unit according to claim 1, wherein:

the driving unit has a linear motor having a coil, a magnet capable of influencing the coil, and a moving mechanism capable of moving the magnet at a high speed.

12. A sheet processing unit according to claim 2, further comprising:

a stopper for regulating a movable range of the movable lever at a predetermined position, and a stopper positioning unit for positioning the stopper at a desired position.

13. A sheet processing unit according to claim 1, further comprising a damper for reducing a disturbance of the sheets.

14. A sheet processing unit according to claim 1, wherein:

the movable lever is movable in a direction perpendicular to each of the piled sheets.

15. A sheet processing unit according to claim 1, further comprising a gas spraying unit for spraying a not-pressed portion of the sheets (to promote to separate the sheets) with gas.

* * * * *